US007980904B2

(12) United States Patent
Miguchi

(10) Patent No.: US 7,980,904 B2
(45) Date of Patent: Jul. 19, 2011

(54) DRIVING POWER OUTPUT CONTROL FOR PERSONAL WATERCRAFT

(75) Inventor: Akio Miguchi, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 479 days.

(21) Appl. No.: 12/126,764

(22) Filed: May 23, 2008

(65) Prior Publication Data

US 2008/0293311 A1 Nov. 27, 2008

(30) Foreign Application Priority Data

May 25, 2007 (JP) ..... 2007-138990

(51) Int. Cl.
*B63H 21/21* (2006.01)

(52) U.S. Cl. ..... 440/1

(58) Field of Classification Search ..... 440/1, 2, 440/84, 87; 701/21; 114/275, 277, 122, 114/144 R, 144 RE, 144 A
See application file for complete search history.

(56) References Cited

U.S. PATENT DOCUMENTS 6,709,302 B2 3/2004 Yanagihara
7,018,254 B2 * 3/2006 Kanno et al. ..... 440/87
7,438,013 B2 * 10/2008 Mizutani ..... 114/144 RE

FOREIGN PATENT DOCUMENTS

| | | |
|---|---|---|
| JP | 03-031096 | 2/1991 |
| JP | 2000-225887 A | 8/2000 |
| JP | 2002-115638 A | 4/2002 |
| JP | 2004-100689 A | 4/2004 |
| JP | 2006-246657 A | 9/2006 |

* cited by examiner

*Primary Examiner* — Edwin Swinehart

(74) *Attorney, Agent, or Firm* — Alleman Hall McCoy Russell & Tuttle LLP

(57) ABSTRACT

A jet-propulsion personal watercraft comprises a body including a hull and a deck, an engine mounted in the body, a driving power output changing system configured to be able to change a driving power output of the engine, a controller configured to control an operation of the driving power output changing system, and a pressure sensor configured to be able to detect a pressure which is applied to the body from the water on which the body is floating, the pressure having a component in a lateral direction of the body, wherein the controller includes a turning determiner configured to determine whether or not the body is turning, based on a signal received from the pressure sensor; and a driving power output control unit configured to control the driving power output changing system based on information received from the turning determiner.

11 Claims, 20 Drawing Sheets

TRANSITION TO NORMAL MODE

DRIVING POWER OUTPUT CONTROL FOR PERSONAL WATERCRAFT

TECHNICAL FIELD

The present invention relates to a jet-propulsion personal watercraft configured to eject a water jet, by an engine driving power, to generate a propulsion force for propelling the watercraft.

BACKGROUND ART

In recent years, jet-propulsion personal watercrafts (PWC) have been widely used in leisure, sport, rescue activities, and the like. The watercraft is typically equipped with an engine in an inner space defined by a hull and a deck forming a body. The engine drives a water jet pump, which pressurizes and accelerates the water that is sucked from a water intake, which is generally provided on a hull bottom surface and ejects it rearward from an outlet port. As the resulting reaction, the watercraft is propelled forward.

In such jet-propulsion personal watercrafts, when a driver operates a throttle lever to close a throttle valve for deceleration of the watercraft, and thereby turns the engine to an idling state while the watercraft is driving on the water surface, a propulsion force for steering the body becomes small. So, when making the watercraft approach a position parallel to a shoreline, the driver must steer a steering handle while manipulating the throttle lever.

A conventional jet-propulsion personal watercraft is equipped with an actuator to restrict a closed position of a throttle valve, which is subjected to a force applied from a return spring in a direction to close the throttle valve. In this watercraft, even when the throttle lever is operated by the driver to close the throttle valve while driving, the actuator restricts a closing operation of the throttle valve immediately before an engine speed reaches an idling engine speed, so that the engine speed is maintained slightly higher than the idling engine speed for a certain time period. This makes it possible to retard time when the engine speed reaches the idling engine speed so that a suitable propulsion force is maintained without a need for the driver to manipulate the throttle lever carefully. Thus, the watercraft can be steered effectively for a longer time period.

However, if the time when the engine speed reaches the idling engine speed is retarded in a case where the watercraft is driving only straight ahead in a deceleration state, the propulsion force is maintained, increasing a distance over which the watercraft is moved until it is stopped. Therefore, in the case where the watercraft is driving only straight ahead in the deceleration state, it is necessary to quickly reduce the engine speed so that the distance over which the watercraft is moved until it is stopped does not become long.

SUMMARY OF THE INVENTION

The present invention addresses the above described conditions, and an object of the present invention is to provide a jet-propulsion personal watercraft, which is capable of determining whether a body is turning, and is capable of controlling a decreased state of an engine driving power output.

According to one aspect of the present invention, there is provided a jet-propulsion personal watercraft comprising a body including a hull and a deck; an engine mounted in the body; a driving power output changing system configured to be able to change a driving power output of the engine; a controller configured to control an operation of the driving power output changing system; and a pressure sensor configured to be able to detect a pressure which is applied to the body from the water on which the body is floating, the pressure having a component in a lateral direction of the body; wherein the controller includes a turning determiner configured to determine whether or not the body is turning, based on a signal received from the pressure sensor; and a driving power output control unit configured to control the driving power output changing system based on an information received from the turning determiner.

The present inventors noted that a distribution of the pressure applied to the body from the water while turning is not laterally symmetric, and it can be determined whether or not the body is turning, based on the pressure which is applied to the body from the water and has the lateral component, which is detected by the pressure sensor. When the turning determiner determines that the body is turning, the engine driving power output is controlled to enable the body to turn suitably.

The controller may include a deceleration determiner configured to determine whether or not the watercraft is decelerating. The driving power output control unit may be configured to control the driving power output changing system to maintain a propulsion force for turning the body when the deceleration determiner determines that the watercraft is decelerating, and the turning determiner determines that the body is turning. It should be noted that the propulsion force for turning the body can be maintained by reducing a decreased rate of the engine driving power output, by maintaining the engine driving power output, by increasing the engine driving power output, or by suitably combining any of them.

In such a configuration, when the turning determiner determines that the body is turning in the deceleration state, the decrease in the engine driving power output is retarded, so that a suitable propulsion force is maintained to turn the body in the deceleration state.

The driving power output control unit may be configured to increase a driving power output of the engine in a case where, the turning determiner determines that the body is turning to maintain the propulsion force for turning the body, so that the driving power output is larger than a driving power output of the engine in a case where the turning determiner determines that the body is not turning.

In such a configuration, the driving power output control unit executes control so that the propulsion force generated for the body which is turning is larger than the propulsion force generated for the body which is not turning. Thus, a suitable propulsion force can be maintained in the case where the body is turning in the deceleration state, or the engine driving power output can be quickly decreased in the case where the body is not turning in the deceleration state, thereby suppressing an increase in the distance over which the watercraft is moved until it is stopped.

The pressure sensor may include a first pressure sensor which is configured to be able to detect a pressure having a rightward component, and a second pressure sensor which is configured to be able to detect a pressure having a leftward component. The turning determiner may be configured to determine that the body is turning, when a difference between the pressure detected by the first pressure sensor and the pressure detected by the second pressure sensor is not smaller than a predetermined value.

In such a configuration, it can be determined precisely whether or not the body is turning, simply by using the first and second pressure sensors, which are respectively able to accurately detect the pressure having the rightward component and the pressure having the leftward component, which are applied from the water to the body being turned, based on the difference between the pressures.

The first pressure sensor may be disposed to detect a rightward pressure, and the second pressure sensor may be disposed to detect a leftward pressure.

The first pressure sensor may be disposed to detect a pressure in one direction which is substantially perpendicular to a turning direction of the body, and the second pressure sensor is configured to detect a pressure in an opposite direction which is substantially opposite to the one direction.

The first pressure sensor may be a right pressure sensor attached on a right side of a rear part of the body, and the second pressure sensor may be a left pressure sensor attached on a left side of the rear part of the body.

In such a configuration, since the right and left pressure sensors are attached on the rear part of the body which is moved in the lateral direction with a larger amount while turning, a relative movement of the body with respect to the water can be effectively detected.

The pressure sensor may be a single pressure sensor attached on the body. The turning determiner may determine that the body is turning when the pressure detected by the pressure sensor is outside a reference range.

In such a configuration, it can be determined whether or not the body is turning, by using the single pressure sensor.

The jet-propulsion personal watercraft may further comprise an engine speed sensor configured to be able to detect an engine speed of the engine. The driving power output changing system may include an air-intake passage through which air taken in from outside is guided to the engine, an intake valve configured to substantially open and close the air-intake passage, and an intake valve driving device configured to drive the intake valve. The intake valve may be attached with an opening degree sensor configured to be able to detect an opening degree of the intake valve. The deceleration determiner may determine that the watercraft is decelerating when the engine speed detected by the engine speed sensor is not lower than a predetermined value, and the opening degree detected by the opening degree sensor is not larger than a predetermined value.

In such a configuration, the deceleration state of the watercraft can be determined suitably.

The jet-propulsion personal watercraft may further comprise a speed sensor configured to be able to detect a relative speed of the water on which the body is floating, with respect to the body, the relative speed having a lateral component. The turning determiner may be configured to determine whether or not the body is turning based on a signal received from the speed sensor.

In such a configuration, it can be determined whether or not the body is turning, based on the relative speed of the water with respect to the body, having the lateral component, which is detected by the speed sensor, because the body is moved in the lateral direction with respect to the water while turning.

The speed sensor may be attached on a rear part of the body. The turning determiner may determine that the body is turning, when a relative speed having the lateral component which is detected by the speed sensor is not lower than a predetermined value.

In such a configuration, it can be determined precisely whether or not the body is turning, simply by using the speed sensor which is able to accurately detect that the body is moved in the lateral direction with respect to the water. In addition, since the speed sensor is attached on the rear part of the body which is moved in the lateral direction with a larger amount while turning, a relative speed of the body with respect to the water which has the lateral component can be effectively detected.

The jet-propulsion personal watercraft may further comprise an acceleration sensor configured to be able to detect an acceleration of the body, the acceleration having a lateral component. The turning determiner may determine whether or not the body is turning based on a signal received from the acceleration sensor.

In such a configuration, it can be determined whether or not the body is turning based on the acceleration of the body, having the lateral component, which is detected by the acceleration sensor, because the body is moved in the lateral direction with respect to the water while turning.

The jet-propulsion personal watercraft may further comprise a global positioning system sensor, configured to be able to obtain location information of the body. The turning determiner may determine whether or not the body is turning based on a signal received from the global positioning system sensor.

In such a configuration, it can be determined whether or not the body is turning, based on the movement track obtained by detecting the location information of the body substantially continuously using the GPS sensor, because the body is moved in the lateral direction with respect to the water while turning.

The jet-propulsion personal watercraft may further comprise a posture sensor, configured to be able to detect a posture of the body. The turning determiner may be configured to determine whether or not the body is turning, based on a signal received from the posture sensor.

In such a configuration, it can be determined whether or not the body is turning, based on the posture detected by the posture sensor, because the body is tilted in the lateral direction while turning.

The driving power output changing system may include an air-intake passage through which air taken in from outside is guided to the engine, an intake valve configured to substantially open and close the air-intake passage, and an intake valve driving device configured to drive the intake valve. The driving power output control unit may be configured to execute valve opening degree control, for causing the intake valve driving device to control the opening degree of the intake valve to maintain a propulsion force for turning the body, when the deceleration determiner determines that the watercraft is decelerating and the turning determiner determines that the watercraft is turning. As used herein, the term "intake valve" refers to a throttle valve, a bypass valve, etc.

In such a configuration, since the opening degree of the intake valve is controlled to suppress decrease in an air-intake amount even though the driver has performed an operation for deceleration of the watercraft, the propulsion force can be provided with a simple configuration.

The intake valve may include a throttle valve configured to substantially open and close the air-intake passage according to an amount of a driver's operation, and a bypass valve configured to substantially open and close a bypass passage connected to the air-intake passage so as to bypass the throttle valve. The intake valve driving device may be a bypass valve driving device configured to drive the bypass valve. The driving power output control unit may be configured to execute valve opening degree control for causing the bypass valve driving device to increase or maintain the opening degree of the bypass valve, when the deceleration determiner determines that the watercraft is decelerating and the turning determiner determines that the watercraft is turning.

In such a configuration, the opening degree of the bypass valve is increased or maintained even though the driver has performed an operation for deceleration of the watercraft to cause the throttle valve to be moved to an idling opening degree corresponding to an idling engine speed. Therefore, with a simple configuration, it becomes possible to increase the time period during which the watercraft is effectively steered before the engine speed reaches the idling engine speed.

The driving power output changing system may include an ignition device configured to ignite an air-fuel mixture in the engine. The driving power output control unit may be configured to execute ignition timing control for increasing an advancement angle value of ignition timing of the ignition device, when the deceleration determiner determines that the watercraft is decelerating and the turning determiner determines that the watercraft is turning.

In such a configuration, the ignition timing is put ahead to increase the engine driving power output, even though the driver has performed an operation to cause the throttle valve to be moved to the idling opening degree corresponding to the idling engine speed, for deceleration of the watercraft. Therefore, with a simple configuration, the propulsion force for turning the watercraft can be obtained.

According to another aspect of the present invention, there is provided a jet-propulsion personal watercraft comprising a body including a hull and a deck; an engine mounted in the body; a driving power output changing system configured to be able to change a driving power output of the engine; a controller configured to control an operation of the driving power output changing system; and a sensor configured to be able to detect a relative speed of water on which the watercraft is floating, or an acceleration of the body, the relative speed or the acceleration having a component in a lateral direction of the body; wherein the controller includes a turning determiner configured to determine whether or not the body is turning, based on a signal received from the sensor; and a driving power output control unit configured to control the driving power output changing system based on information received from the turning determiner.

The present inventors noted that the relative speed of the water with respect to the body or the acceleration of the body being turned has a lateral component, and it can be determined whether or not the body is turning based on the relative speed of the water with respect to the body or the acceleration of the body, which is detected by the sensor. When the determiner determines that the body is turning, the engine driving power output is controlled to enable the body to turn suitably.

According to a further aspect of the present invention, there is provided a jet-propulsion personal watercraft comprising a body including a hull and a deck; an engine mounted in the body; a driving power output changing system configured to be able to change a driving power output of the engine; a controller configured to control an operation of the driving power output changing system; and a sensor configured to be able to detect location information of the body or a posture of the body; wherein the controller includes a turning determiner configured to determine whether or not the body is turning based on a signal received from the sensor; and a driving power output control unit configured to control the driving power output changing system based on information received from the turning determiner.

In such a configuration, it can be suitably determined whether or not the body is turning, based on the location information, or the posture of the body.

The above and further objects and features of the invention will more fully be apparent from the following detailed description with accompanying drawings.

DETAILED DESCRIPTION OF THE PREFERRED EMBODIMENTS

Hereinafter, embodiments of the present invention will be described with reference to the accompanying drawings. As used herein, the directions are referenced from a perspective of a driver (not shown) straddling a jet-propulsion personal watercraft.

Embodiment 1

Figure 1:
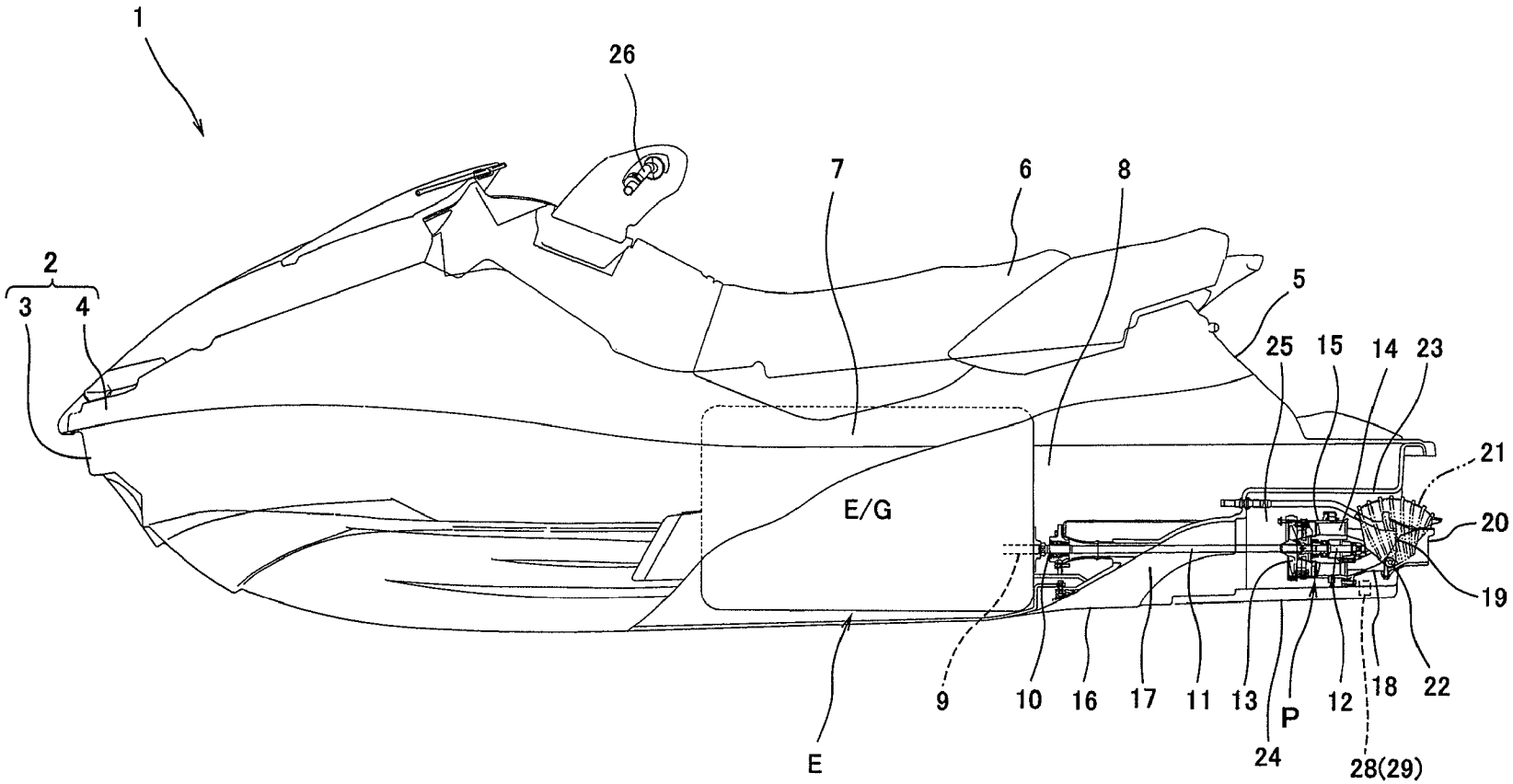
FIG. 1 is a partially cutaway side view of a jet-propulsion personal watercraft according to a first embodiment of the present invention, as seen from the left.
Figure 2:
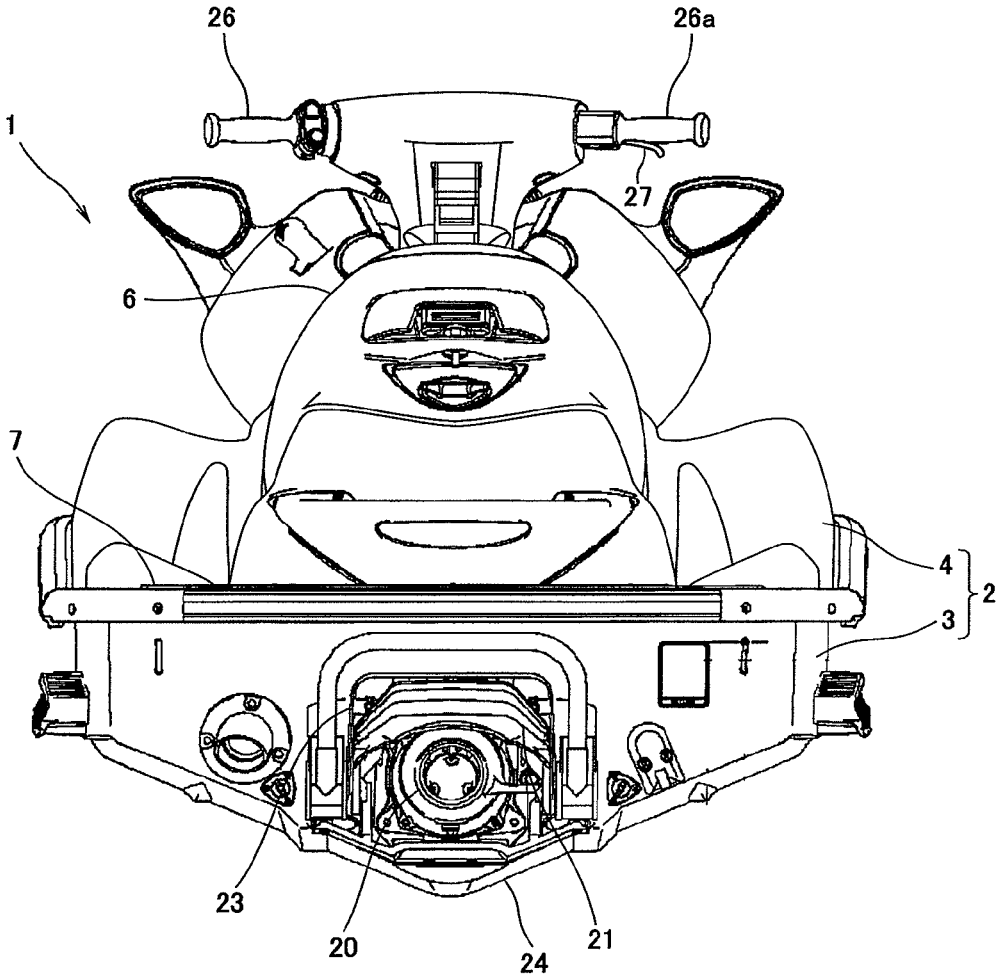
FIG. 2 is a rear view of the jet-propulsion personal watercraft of FIG. 1.

FIG. 1 is a partially cutaway side view of a jet-propulsion personal watercraft 1 as seen from the left. FIG. 2 is a rear view of the jet-propulsion personal watercraft 1 of FIG. 1. With reference to FIGS. 1 and 2, the jet-propulsion personal watercraft 1 is a straddle-type jet-propulsion personal watercraft which is provided with a seat 6 straddled by the driver. A body 2 of the watercraft 1 comprises a hull 3 and a deck 4 covering the hull 3 from above. A center portion (protruding portion) 5 in a width direction of a rear part of the deck 4 protrudes upward. The seat 6 is mounted over an upper surface of the protruding portion 5. A deck floor 7 is formed on the right and the left sides in the width direction of the protruding portion 5, and it is configured to be substantially flat and lower than the protruding portion 5 to enable driver's feet to be put thereon.

An inner space defined by the hull 3 and the deck 4 below the seat 6 forms an engine room 8 which accommodates the engine E. The engine E is mounted in the engine room 8 in such a manner that a crankshaft 9 extends in a longitudinal direction of the body 2. An engine speed sensor 61 (see FIG. 8) which is a crank angle sensor is attached on the crankshaft 9. An ECU 60 (see FIG. 8), which is a controller, calculates and detects a rotational angle of the crankshaft 9 based on a signal received from the engine speed sensor 61, thus detecting an engine speed of the engine E.

An output end portion of the crankshaft 9 is coupled to a propeller shaft 11 via a coupling member 10. A pump accommodating space 25 is formed in a rear part of the hull 3, in a center position, in a lateral direction of the body 2, and includes a tunnel-shaped plate 23 having an inverted concave cross-section and a bottom cover 24 for closing a lower opening of the tunnel-shaped plate 23. A water jet pump P is disposed in the pump accommodating space 25. The propeller shaft 11 is coupled to a pump shaft 12 of the water jet pump P. The pump shaft 12 is rotatable in association with the rotation of the crankshaft 9. An impeller 13 is attached on the pump shaft 12 and fairing vanes 14 are provided behind the impeller 13. A tubular pump casing 15 is provided on the outer periphery of the impeller 13 so as to contain the impeller 13.

A water intake 16 opens on a bottom region of the body 2. The water intake 16 is connected to the pump casing 15 through a water passage 17. The pump casing 15 is coupled to a pump nozzle 18 provided on the rear side of the body 2. The pump nozzle 18 has a cross-sectional area that gradually reduces rearward, and an outlet port 19 opens at a rear end of the pump nozzle 18. A steering nozzle 20 is coupled to the outlet port 19 of the pump nozzle 18 and is configured to be pivotable clockwise and counterclockwise.

The water outside the watercraft 1 is sucked from the water intake 16 on the bottom region of the hull 3, and is fed to the water jet pump P. Driven by the engine E, the water jet pump P causes the impeller 13 to be rotated, thereby pressurizing and accelerating the water. The fairing vanes 14 guide the water flow behind the impeller 13. The water jet is ejected rearward from the outlet port 19 of the pump nozzle 18 and through the steering nozzle 20. As a resulting reaction, the watercraft 1 obtains a propulsion force. A bowl-shaped reverse deflector 21 is provided on an upper portion of the steering nozzle 20 such that it is vertically pivotable around a horizontally mounted pivot shaft 22.

A bar-type steering handle 26 is disposed in front of the seat 6. A throttle lever 27 is mounted to a right grip 26*a* of the steering handle 26. The throttle lever 27 is pivotable according to a gripping operation of the driver's right hand. The steering handle 26 is connected to the steering nozzle 20 through a steering cable (not shown). When the driver rotates the steering handle 26 clockwise or counterclockwise, the steering nozzle 20 is pivoted toward the opposite direction, so that the ejection direction of the water being ejected through the steering nozzle 20 can be changed, and the watercraft 1 can be correspondingly turned to any desired direction while the water jet pump P is generating the propulsion force.

Figure 3:
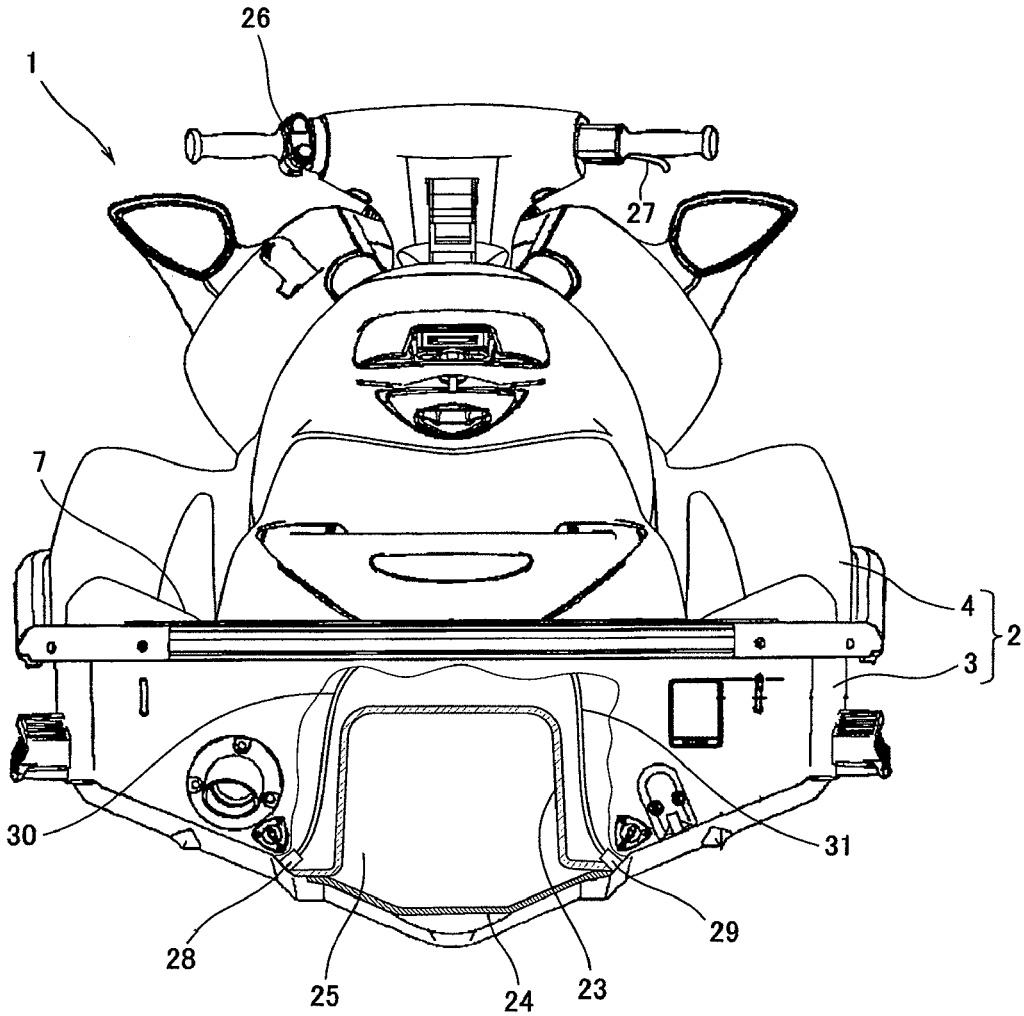
FIG. 3 is a partially cutaway rear view of the jet-propulsion personal watercraft of FIG. 1.

FIG. 3 is a partially cutaway rear view of the jet-propulsion personal watercraft 1 of FIG. 1. As shown in FIG. 3, a left pressure sensor 28 and a right pressure sensor 29 are attached on the rear part of the hull 3, at a left side of the pump space 25 positioned, at the center, in a lateral direction of the body 2, and at a right side of the pump space 25, respectively. To be specific, the left pressure sensor 28 and the right pressure sensor 29 are laterally symmetric, and are located lower than the surface of the water on which the body 2 is floating. Output cables 30 and 31 of the left pressure sensor 28 and the right pressure sensor 29 are respectively coupled to the ECU 60 (see FIG. 8).

Figure 4:
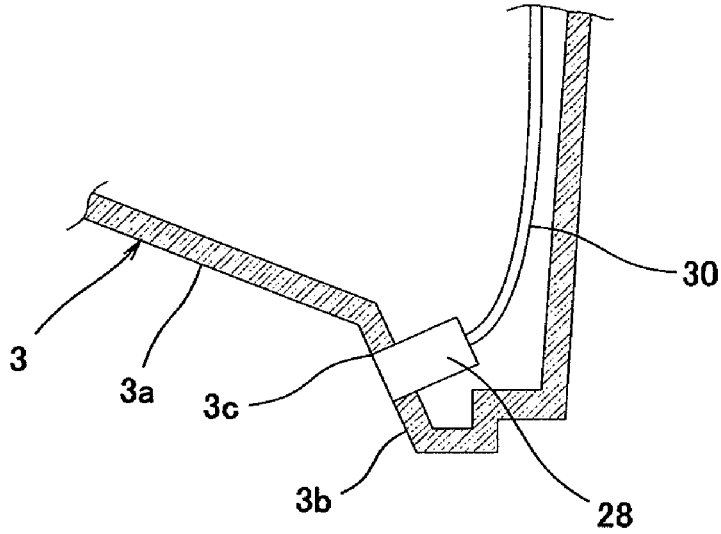
FIG. 4 is a cross-sectional view showing a region surrounding a pressure sensor in the jet-propulsion personal watercraft of FIG. 3.

FIG. 4 is a cross-sectional view showing a region surrounding the left pressure sensor 28 in the jet-propulsion personal watercraft 1 of FIG. 3. As shown in FIG. 4, in a bottom wall portion 3*a* of the hull 3, an attachment hole 3*c* is formed on a left pressure-receiving portion 3*b* which receives a water pressure from the left and is located in a region of the bottom wall portion 3*a* whose normal line direction is closest to a horizontal direction. The left pressure sensor 28 is attached in the attachment hole 3*c*. To be more specific, a pressure detecting part of the left pressure sensor 28 is directed leftward and is in contact with the water. The left pressure sensor 28 is configured to detect the pressure of the water on which the body 2 is floating, which is applied from the left. This makes it possible for the left pressure sensor 28 to detect a pressure of the water which is applied to the body 2 and has a rightward component while the body 2 is turning. The right pressure sensor 29 will not be further described since the right pressure sensor 29 and the left pressure sensor 28 are laterally symmetric.

Figure 5:
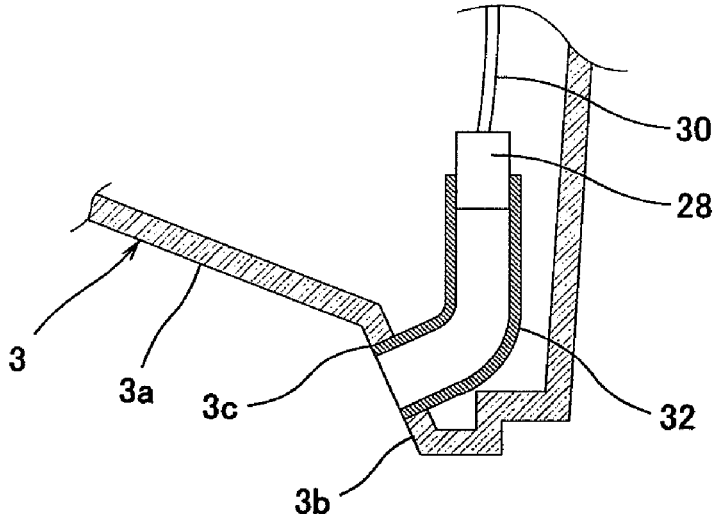
FIG. 5 is a view showing an alternative example of the region surrounding the pressure sensor of FIG. 4.

In an alternative example, as shown in FIG. 5, an outer end portion of a guide pipe 32 may be attached in the attachment hole 3*c* of the hull 3 and the pressure sensor 28 may be attached on an inner end of the guide pipe 32. In this case, the pressure sensor 28 is positioned under the water surface of the water on which the body 2 is floating.

Figure 6:
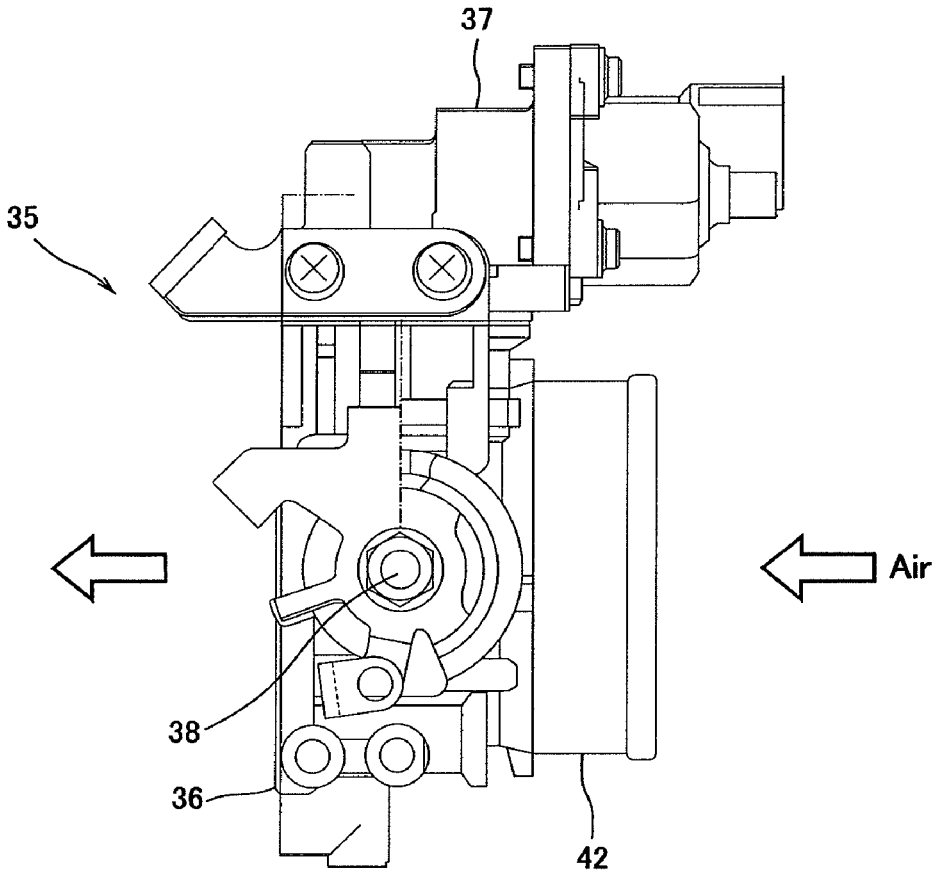
FIG. 6 is a side view of a throttle system in the jet-propulsion personal watercraft of FIG. 1.
Figure 7:
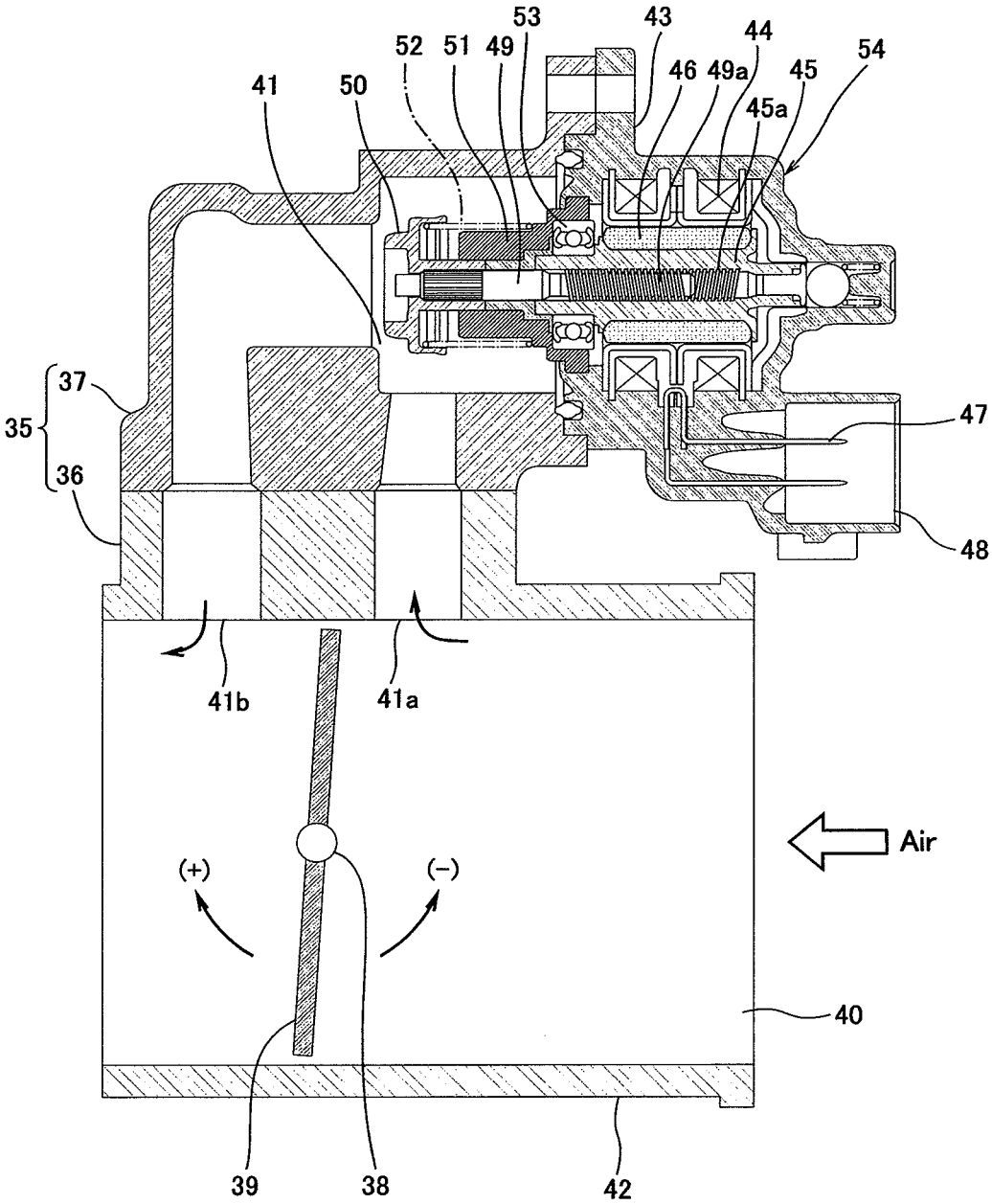
FIG. 7 is a cross-sectional view of the throttle system in the jet-propulsion personal watercraft of FIG. 1.

FIG. 6 is a side view of a throttle system 35 in the jet-propulsion personal watercraft 1 of FIG. 1. FIG. 7 is a cross-sectional view of the throttle system 35 in the watercraft 1 of FIG. 1. As shown in FIGS. 6 and 7, the throttle system (driving power output changing system) 35 includes a main throttle body 36 having a tubular air-intake portion 42 forming an air-intake passage 40 (see FIG. 3) therein and an idle control body 37. An upstream opening of the tubular air-intake portion 42 of the main throttle body 36 is coupled to an air box (not shown), and a downstream opening thereof is coupled to an intake manifold (not shown) of the engine E (FIG. 1). A throttle shaft 38 is rotatably disposed within the tubular air-intake portion 42. A disc-shaped throttle valve 39 is fixed on the throttle shaft 38 and is disposed in the air-intake passage 40 in the interior of the tubular air-intake portion 42.

The throttle shaft 38 is rotatable in association with the pivot operation of the throttle lever 27 (see FIG. 3) via a throttle wire (not shown), etc. The throttle valve 39 is opened and closed according to the driver's hand operation of the throttle lever 27. A return spring (not shown) is mounted to the throttle shaft 38, and is configured to apply a force to cause the throttle shaft 38 to return in a direction to close the throttle valve 39 in a state, where a force resulting from the driver's hand operation of the throttle lever 27 is not transmitted to the throttle shaft 38. A throttle position sensor 62 (FIG. 8) which is an opening degree sensor, is coupled to the throttle shaft 38. The ECU 60 (see FIG. 8) calculates and detects, based on a signal received from the throttle position sensor 62, a rotational angle of the throttle valve 39 which is rotatable integrally with the throttle shaft 38. A fuel injector (not shown) is attached on the intake manifold to inject a fuel to the air which is taken in from outside and supplied to the engine E.

Turning to FIG. 7, the idle control body 37 forms a bypass passage 41 connected to the air-intake passage 40 in parallel so as to bypass the throttle valve 39. The bypass passage 41 has an inlet 41*a* connected to the air-intake passage 40 in a location upstream of the throttle valve 39 in the air flow direction, and an outlet 41*b* connected to the air-intake passage 40 in a location downstream of the throttle valve 39. The idle control body 37 is provided with a bypass valve 50 (intake valve) which serves to increase and decrease a flow cross-sectional area of the bypass passage 41. The bypass valve 50 is attached with a bypass valve motor (bypass valve driving device) 54 which causes the bypass valve 50 to be extended and retracted.

The bypass valve motor 54 has a stator 43 forming an outer tube thereof. An armature coil 44 is mounted to an inner peripheral surface of the stator 43. The stator 43 is provided with a connector accommodating portion 48. A terminal 47 protrudes into the interior of the connector accommodating portion 48 and is electrically connected to the armature coil 44. A cylindrical rotor 45 is rotatably mounted in an inner space of the stator 43. A permanent magnet 46 is attached to an outer peripheral surface of the rotor 45 to be opposite to the armature coil 44. An internal threaded portion 45*a* is formed in a desired location of an inner peripheral surface of the rotor 45.

A drive shaft 49 is inserted into an inner space of the rotor 45. The bypass valve 50 is spline-coupled to a tip end portion of the drive shaft 49 on the bypass passage 41 side. An external threaded portion 49*a* is formed on an outer peripheral surface of the drive shaft 49, and is threadedly engaged with an internal threaded portion 45*a* of the rotor 45. A holder 51 is externally fitted to the rotor 45 by a bearing 53. The holder 51 is mounted on the stator 43 and is configured to guide the drive shaft 49 and the bypass valve 50. One end portion of the spring 52 is coupled to the holder 51, and an opposite end portion thereof is coupled to the bypass valve 50. In the bypass valve motor 54 thus constructed, when a current flows in a desired amount in the armature coil 44, the rotor 45 rotates, causing the drive shaft 49 to be axially extended and retracted, because the internal threaded portion 45*a* and the external threaded portion 49*a* are threadedly engaged with each other. As a result, the bypass valve 50 mounted to the tip end portion of the drive shaft 49 operates to open or close the bypass passage 41 to increase or decrease the flow cross-sectional area of the bypass passage 41.

Figure 8:
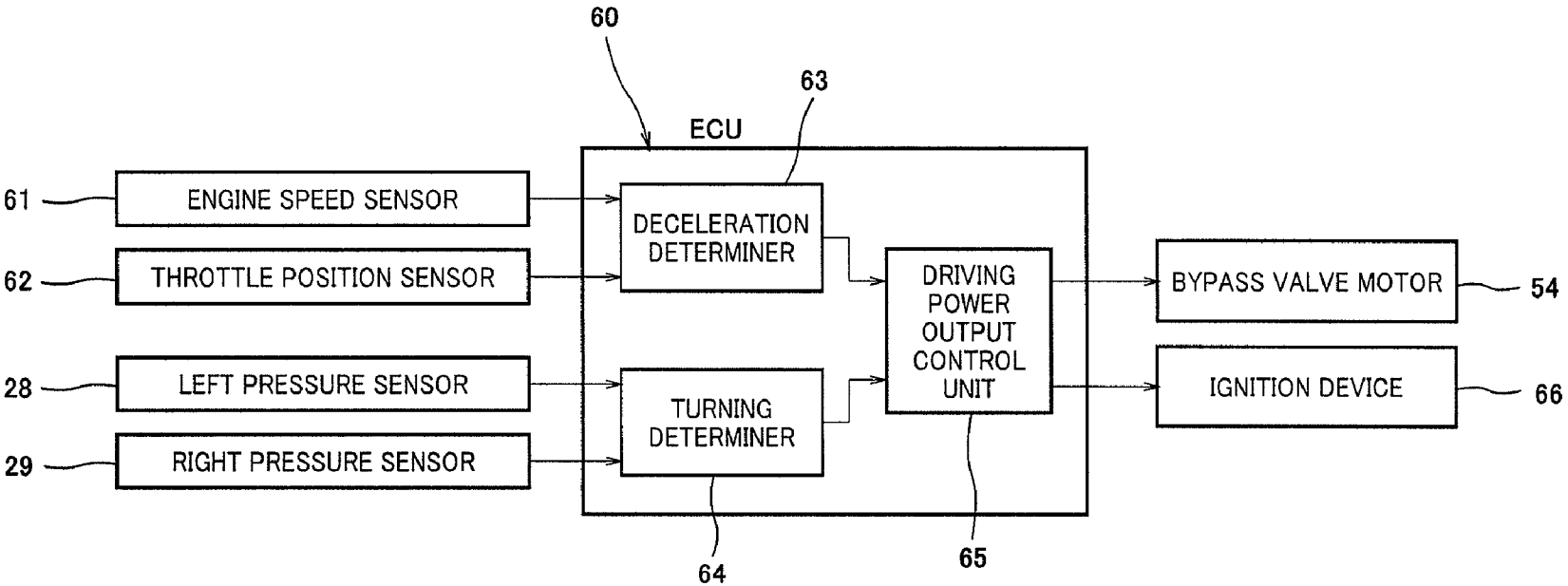
FIG. 8 is a block diagram showing an ECU and other components built into the jet-propulsion personal watercraft of FIG. 1.

FIG. 8 is a block diagram showing an ECU (electronic control unit) 60 and other components mounted in the watercraft 1 shown in FIG. 1. As shown in FIG. 8, the engine speed sensor 61 that detects the rotational angle of the crankshaft 9 (FIG. 1) of the engine E (FIG. 1) to thereby obtain the engine speed, the throttle position sensor 62 that detects the opening degree of the throttle valve 39 (FIG. 7), the left pressure sensor 28, and the right pressure sensor 29 are communicatively coupled to the ECU 60. In addition, the bypass valve motor 54 for driving the bypass valve 50 (FIG. 7) which substantially opens and closes the bypass passage 41 (FIG. 7), and an ignition device (driving power output changing system) 66 for igniting an air-fuel mixture in the engine E (FIG. 1), are communicatively coupled to the ECU 60.

The ECU 60 includes a deceleration determiner 63 configured to determine whether or not the watercraft 1 is decelerating in a predetermined state, a turning determiner 64 configured to determine whether or not the watercraft 1 is turning in a predetermined state, and a driving power output control unit 65 which controls the bypass valve motor 54 and the ignition device 66 based on information received from the deceleration determiner 63 and the turning determiner 64. The deceleration determiner 63 determines that the watercraft 1 is decelerating when the engine speed detected by the engine speed sensor 61 is not lower than a predetermined value and the throttle opening degree detected by the throttle position sensor 62 is not larger a predetermined value. The turning determiner 64 determines that the body 2 of the watercraft 1 is turning when a difference between the pressure detected by the left pressure sensor 28, and the pressure detected by the right pressure sensor 29, is not smaller than a predetermined value. The driving power output control unit 65 causes the bypass valve motor 54 to increase or maintain the opening degree of the bypass valve 50 and the ignition device 66 to put ignition timing ahead, suppressing a decrease in an engine driving power output (engine speed) when the deceleration determiner 63 determines that the watercraft 1 is decelerating, and the turning determiner 64 determines that the body 2 is turning.

Figure 9:
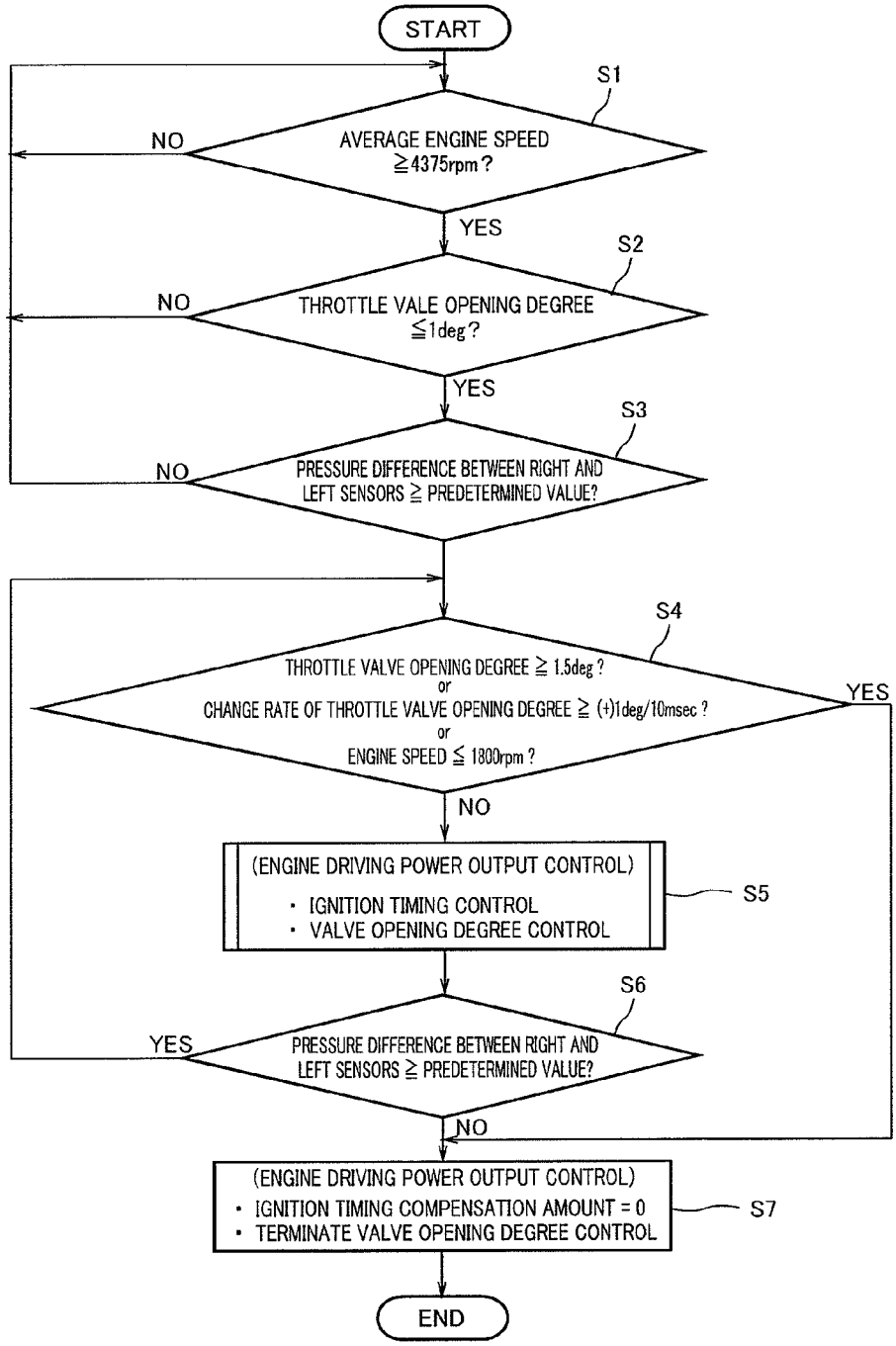
FIG. 9 is a flowchart showing an engine driving power output control in a deceleration state of the jet-propulsion personal watercraft of FIG. 1.

Subsequently, the engine driving power output control in the deceleration state of the watercraft 1 will be described. FIG. 9 is a flowchart showing the engine driving power output control in the deceleration state of the watercraft 1 of FIG. 1. As shown in FIG. 9, initially, the ECU 60 (FIG. 8) determines whether or not an average engine speed is not lower than a predetermined value (e.g., 4375 rpm) (step S1). If the average engine speed is not lower than 4375 rpm, then it is estimated that the watercraft 1 is driving at a speed higher than a certain speed, and therefore a speed of the water jet for generating the propulsion force is likely to be lower than a vehicle speed of the body 2 of the watercraft 1 when the driver operates the throttle lever 27 to close the throttle valve 39. To avoid this, the control for increasing the engine driving power output is executed.

If it is determined that the average engine speed is lower than 4375 rpm (NO in step S1), the ECU 60 returns the process to step S1. On the other hand, if it is determined that the average engine speed is not lower than 4375 rpm (YES in step S1), the ECU 60 further determines whether or not the opening degree of the throttle valve 39 is not larger than a predetermined value (e.g., 1 deg) (step S2). If it is determined that the opening degree of the throttle valve 39 is larger than 1 degree (NO in step S2), the ECU 60 returns the process to step S1. On the other hand, if it is determined that the throttle valve opening degree is not larger than 1 degree (YES in step S2), the ECU 60 further determines that a difference between the pressure detected by the left pressure sensor 28 and the pressure detected by the right pressure sensor 29 is not smaller than a predetermined value (step S3).

If it is determined that the difference between the pressure detected by the left pressure sensor 28 and the pressure detected by the right pressure sensor 29 is smaller than the predetermined value (NO in step S3), the ECU 60 determines that the body 2 is not turning and returns the process to step S1. On the other hand, if it is determined that the difference is not smaller than the predetermined value (YES in step S3), the ECU 60 further determines whether or not specified termination conditions are met (step S4).

To be specific, the ECU 60 determines whether or not any of following conditions are met (step S4).

Condition (1): Throttle valve Opening Degree≧1.5 deg

Condition (2): CHANGE RATE OF Throttle Valve Opening Degree≧(+)1 deg/10 msec

Condition (3): INSTANT ENGINE SPEED≦1800 rpm

If the condition (1) or (2) is met, the ECU 60 determines that the driver has operated the throttle lever 27 to accelerate the watercraft 1, and terminates the engine driving power output control in the deceleration state. If the condition (3) is met, the engine driving power output control is terminated so that the engine speed smoothly reaches the idling engine speed, because the engine speed has been already lowered. The sign (+) indicates that the throttle valve 34 rotates in an opening direction.

If any of the conditions (1) to (3) are met, the engine driving power output control (ignition timing control and valve opening degree control) as described later is terminated (step S7). On the other hand, if none of the conditions (1) to (3) are met, the engine driving power output control which is a sub-routine for suppressing a decrease in the engine driving power output is executed in such a manner that the ignition timing control and valve opening degree control are executed in parallel (step S5).

Figure 10:
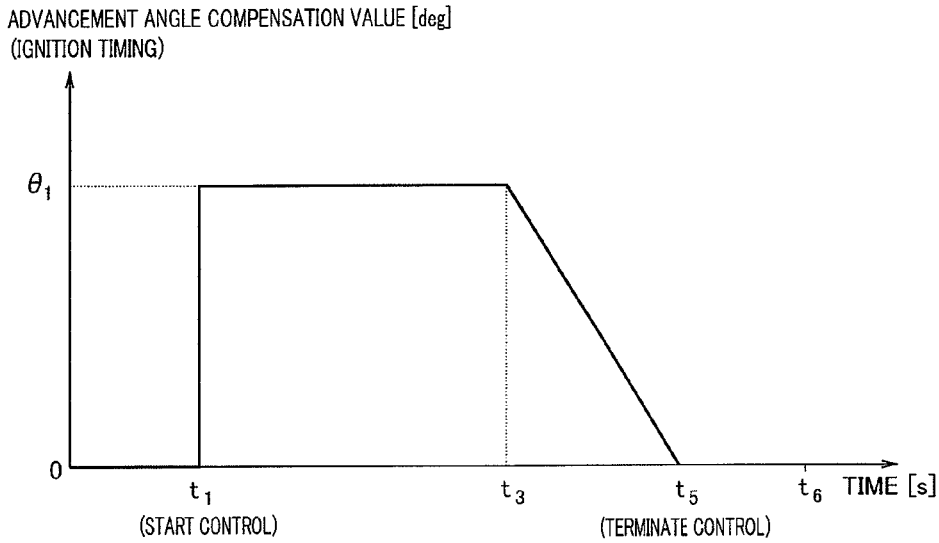
FIG. 10 is a graph showing ignition timing which is associated with ignition timing control in the jet-propulsion personal watercraft of FIG. 1.

Hereinafter, the ignition timing control and the valve opening degree control executed in step S5 will be described in detail separately. FIG. 10 is a graph showing ignition timing associated with the ignition timing control for the watercraft 1 of FIG. 1. The engine speed generally increases with an increase in an advancement angle compensation value. As shown in FIG. 10, the ignition timing control is started at a time point t1. Initially, the advancement angle compensation value is increased from 0 degree before the ignition timing control, to θ1 (e.g., 30 degrees). After a lapse of a time period (e.g., t3−t1=800 msec), the advancement angle compensation value is decreased proportionally at a rate of change of 1 deg/90 msec. Then, at a time point t5 when the advancement angle compensation value reaches zero, the ignition timing control is terminated.

Figure 11:
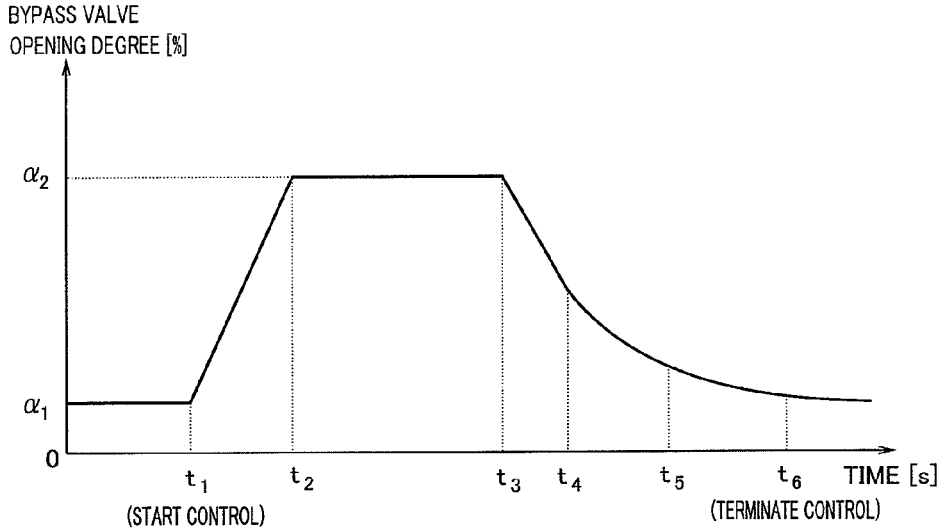
FIG. 11 is a graph showing a bypass valve opening degree which is associated with valve opening degree control in the jet-propulsion personal watercraft of FIG. 1.

FIG. 11 is a graph showing the bypass valve opening degree which is associated with the valve opening degree control in the watercraft 1 of FIG. 1. In FIG. 11, the bypass valve opening degree is defined as: a fully closed position of the bypass valve 50 (FIG. 7) in the bypass passage 41 (FIG. 7) is 0%, and a fully open position thereof is 100%. As shown in FIG. 7, the valve opening degree control is started at a time point t1. Initially, the bypass valve opening degree is increased proportionally from α1 at a rate of change of 0.83%/10 msec. Then, at a time point t2 when it is detected that the engine speed has been decreased to 3000 rpm and the bypass valve opening degree is α2, the bypass valve opening degree is feedback-controlled so that the engine speed is thereafter maintained at 3000 rpm. After a lapse of a time interval (t3−t2) during which the engine speed is maintained at 3000 rpm (e.g., t3−t1=800 msec), the bypass valve opening degree is decreased proportionally at a change rate of 0.83%/30 msec.

From a time point t4 when the engine speed reaches a value, for example, 1800 rpm, which is slightly higher than an idling engine speed (e.g., 1300 rpm), a tailing control is executed to gradually converge the bypass valve opening degree to an idling opening degree corresponding to the idling engine speed. At a time point t6 which is a time point a little time before the engine speed reaches the idling engine speed, the valve opening degree control is terminated, and transitions to an idling mode. In this case, by setting the time point t6 when the valve opening degree control is terminated later than the time point t5 when the ignition timing control is terminated, the engine speed is inhibited from becoming lower than a suitable idling engine speed.

Figure 12:
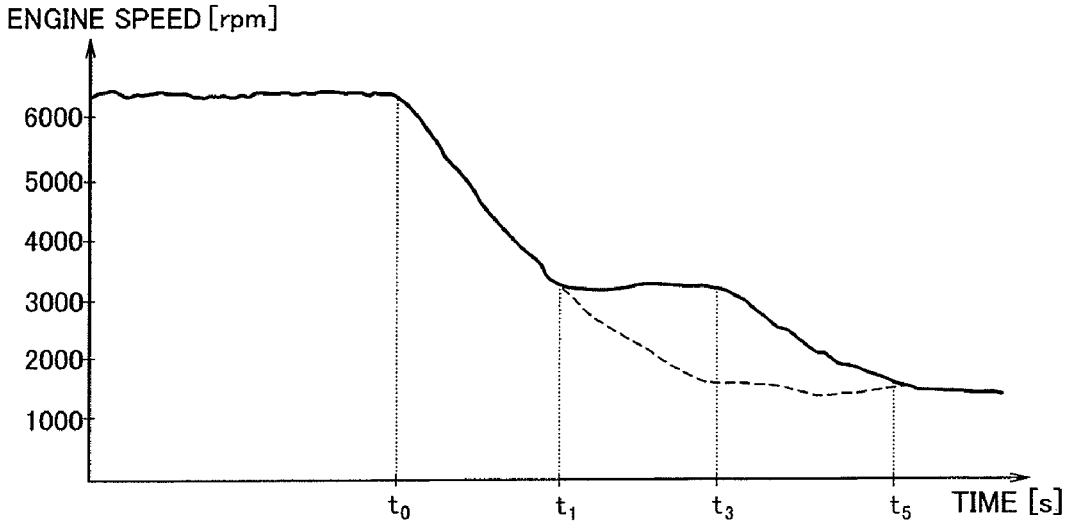
FIG. 12 is a graph showing an engine speed which is associated with an engine driving power output control in the deceleration state of the jet-propulsion personal watercraft of FIG. 1.

FIG. 12 is a graph showing an engine speed which is associated with the engine driving power output control in the deceleration state of the jet-propulsion personal watercraft of FIG. 1. In FIG. 12, a solid line indicates an engine speed of the body 2 which is turning, and a broken line indicates an engine speed of the body 2 which is not turning. That is, the engine speed changes as indicated by the solid line in FIG. 12 if the engine driving power output control including the valve opening degree control and the ignition timing control in the deceleration state is executed.

As shown in FIG. 12, the engine speed starts to be decreased from a time point to when the driver has operated the throttle lever 27 for deceleration of the watercraft 1, and is slightly increased such that the engine speed of the body 2 which is turning is higher than the engine speed of the body 2 which is not turning from a time point t1 when the step S5 is started. After a time point t3, the engine speed is gradually decreased and converges to the idling engine speed. Thus, the engine driving power output control (valve opening degree control and ignition timing control) in step S5 is executed.

Turning to the flowchart FIG. 9 again, while the sub-routine in step S5 is run, it is determined continuously whether or not the difference between the pressure detected by the left pressure sensor 28, and the pressure detected by the right pressure sensor 29 is not smaller than a predetermined value (step S6). If it is determined that the difference between the pressure detected by the left pressure sensor 28 and the pressure detected by the right pressure sensor 29 is not smaller than a predetermined value (YES in step S6), the ECU 60 determines that the body 2 continues to be turning, and return the process to step S4. On the other hand, if it is determined that the difference is smaller than the predetermined value (NO in step S6), the ECU 60 determines that the body 2 is not turning, and sets the ignition timing compensation amount to zero to terminate the ignition timing control, and terminates the valve opening degree control, thus terminating running of the sub-routine in step S5 (step S7). Thereby, the engine driving power output control mode transitions to a normal mode.

In accordance with the above described configuration, it can be determined whether or not the body 2 is turning, based on the difference in the pressures in the lateral direction (horizontal direction perpendicular to a moving direction of the body 2) which are applied from the water to the body 2, and are detected by using the pressure sensors 28 and 29. If the turning determiner 63 determines that the body 2 is turning, in the deceleration state, the decrease in the engine driving power output is retarded, so that the propulsion force generated for the body 2 which is turning is larger than the propulsion force generated for the body 2 which is not turning. Thereby, a suitable propulsion force can be maintained in the case where the body 2 is turning in the deceleration state, or the engine driving power output can be quickly increased in the case where the body 2 is not turning in the deceleration state. Since the pressure sensors 28 and 29 are attached on the rear part of the body 2 which is moved with a larger amount in the lateral direction while turning, they are able to effectively detect a lateral relative movement of the body 2 with respect to the water.

Whereas in the present embodiment, both of the valve opening degree control and the ignition timing control are used as the engine driving power output control for the watercraft 1 in the deceleration state, one of them may be used. Instead of using both of the pressure sensors 28 and 29 as described in the present embodiment, only one of them may be used. For example, when the body 2 is turning to the right, the right pressure sensor 29 is applied with a positive pressure and thereby detects a pressure higher than a reference range, while when the body 2 is turning to the left, the right pressure sensor 29 is applied with a negative pressure and thereby detects a pressure lower than a reference range. Therefore, the left pressure sensor 28 may be omitted, and it may be determined that the body 2 is turning when the pressure detected by the right pressure sensor 29 is outside the reference range.

Embodiment 2

Figure 13:
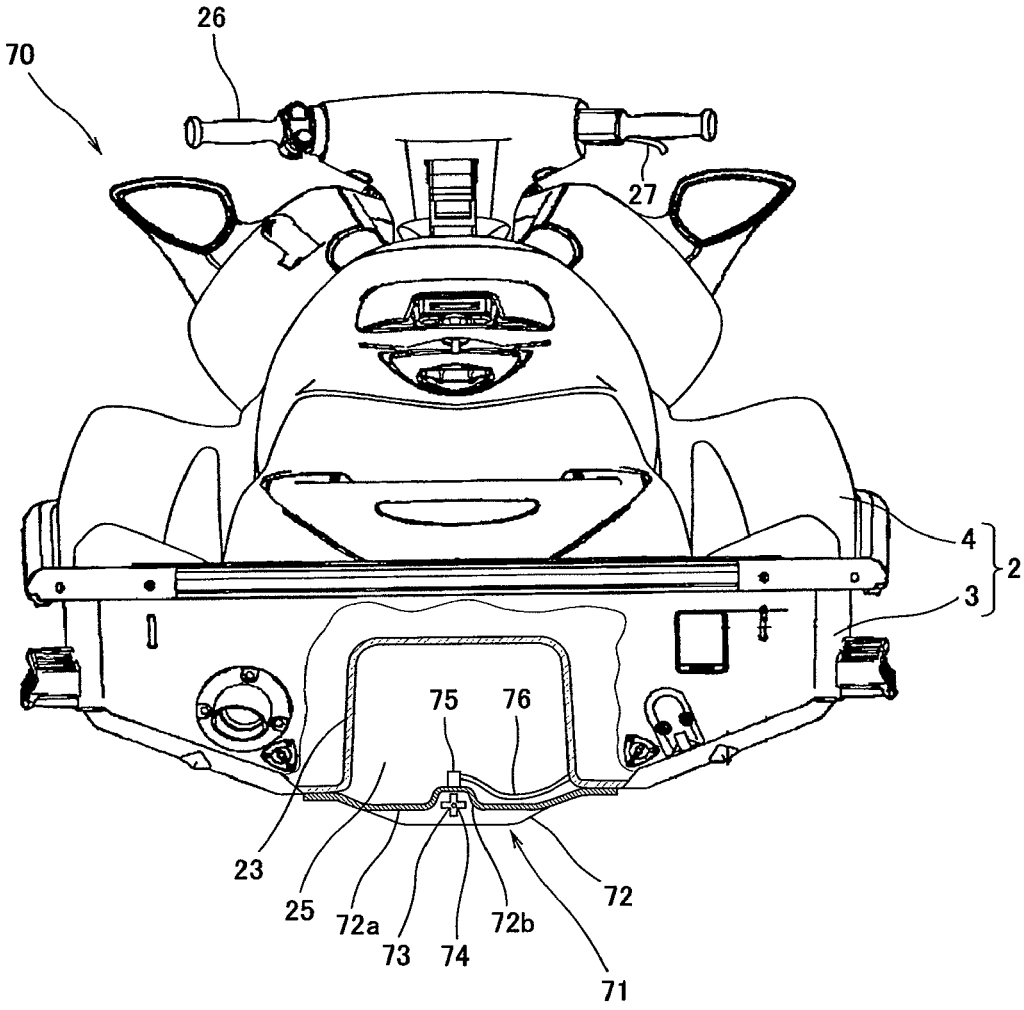
FIG. 13 is a partially cutaway rear view of a jet-propulsion personal watercraft according to a second embodiment of the present invention.

FIG. 13 is a partially cutaway rear view of a jet-propulsion personal watercraft 70 according to a second embodiment of the present invention. In the second embodiment, the same reference numerals as those in the first embodiment denote the same or corresponding parts which will not be further described. As shown in FIG. 13, the pump accommodating space 25 is formed in the rear part of the hull 3 of the watercraft 70, in the center position, in the lateral direction of the body 2, and includes the tunnel-shaped plate 23 having the inverted concave cross-section and a bottom cover 72 for closing the lower opening of the tunnel-shaped plate 23. A groove portion 72*a* which is recessed upward so as to extend in the lateral direction is formed on the bottom cover 72, and a concave portion 72*b* which is recessed upward is formed in a center region in the lateral direction of the groove portion 72.

Figure 14:
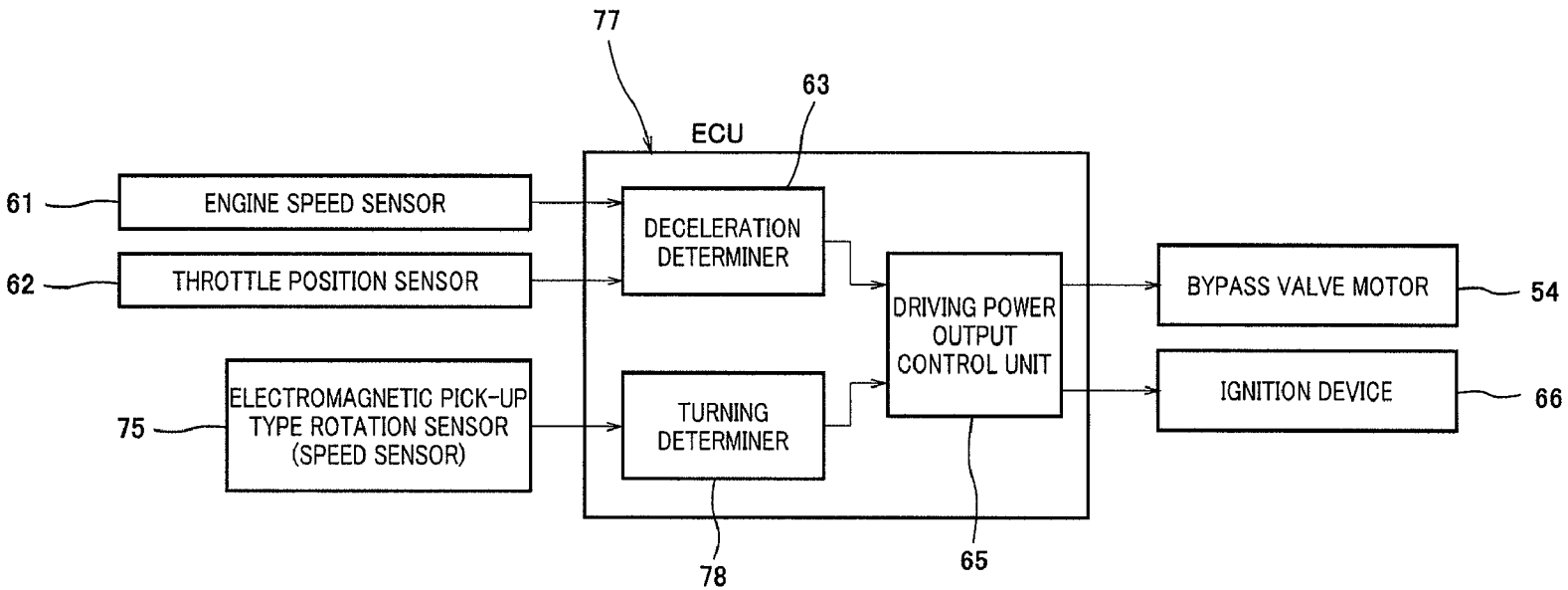
FIG. 14 is a block diagram showing an ECU and other components built into the jet-propulsion personal watercraft of FIG. 13.

A metal-made water wheel 73 having a plurality of vanes is disposed in a space defined by the concave portion 72*b* so as to protrude partially downward. The water wheel 73 is rotatably attached to a rotational shaft 74 having a rotational axis extending in a longitudinal direction of the body 2. An electromagnetic pick-up type rotation sensor 75 is attached on an upper surface of the concave portion 72*b* opposite to the water wheel 73. An output cable 76 of the electromagnetic pick-up type rotation sensor 75 is coupled to an ECU 77 (FIG. 14). If the water on which the body 2 is floating flows in the lateral direction, the water wheel 73 is rotated, and the number of rotations of the water wheel 73 is detected by the electromagnetic pick-up type rotation sensor 75. In other words, the water wheel 73 and the electromagnetic pick-up type rotation sensor 75 form a speed sensor 71 which detects a lateral relative speed of the water with respect to the body 2.

FIG. 14 is a block diagram showing the ECU 77 and other components built into the jet-propulsion personal watercraft 70 of FIG. 13. As shown in FIG. 14, the electromagnetic pick-up type rotation sensor 75 is communicatively coupled to the ECU 77. A turning determiner 78 calculates a lateral relative speed of a water flow passing through the water wheel 73 with respect to the body 2 based on the number of rotations of the water wheel 73, which is detected by the electromagnetic pick-up type rotation sensor 75, and determines that the body 2 is turning in a predetermined state, when the relative speed is not lower than a predetermined value. The engine speed sensor 61, the throttle position sensor 62, the deceleration determiner 63, the driving power output control unit 65, the bypass valve motor 54 and the ignition device 66 operate as in the first embodiment.

Figure 15:
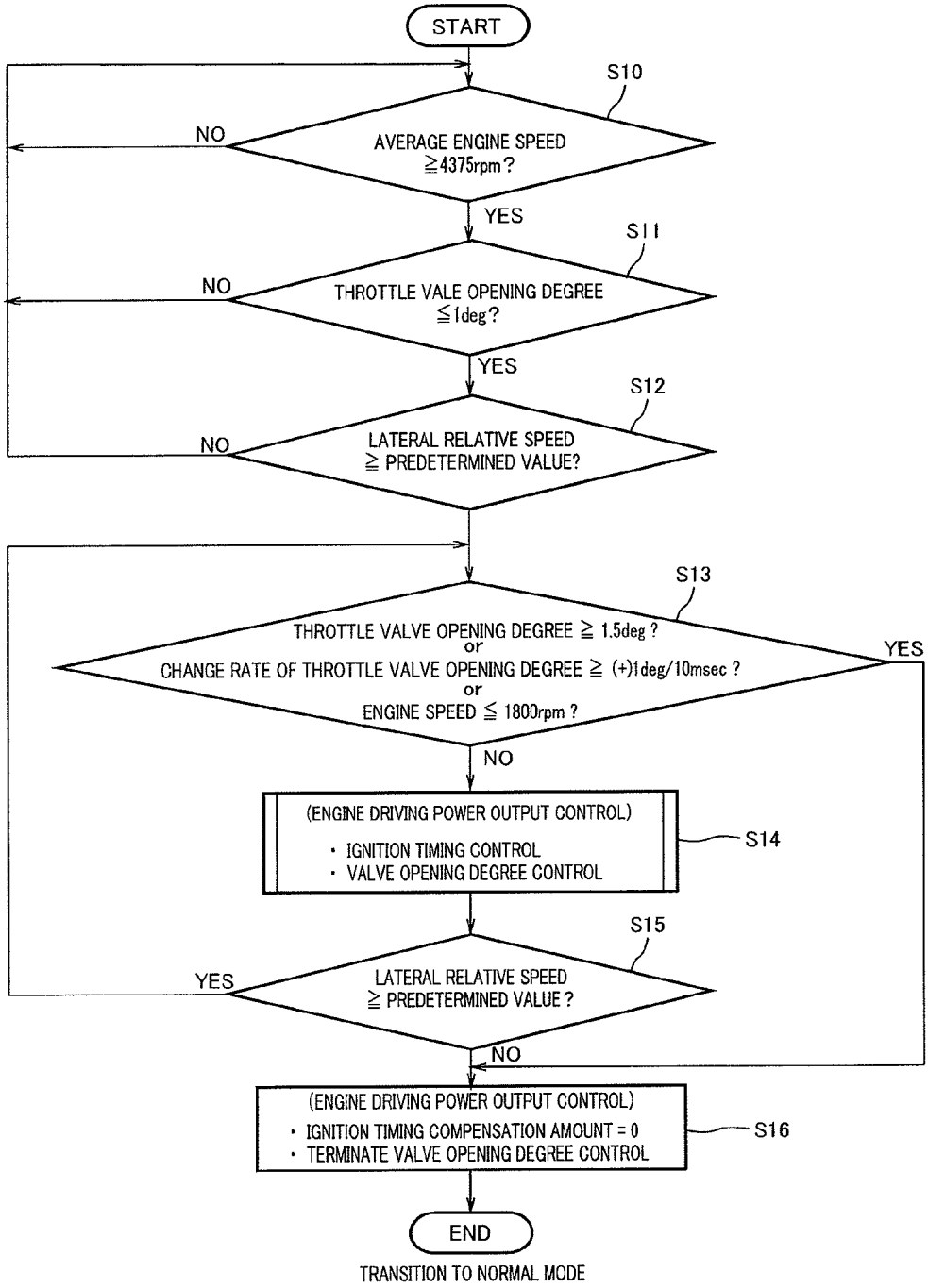
FIG. 15 is a flowchart showing an engine driving power output control in a deceleration state of the jet-propulsion personal watercraft of FIG. 13.

Subsequently, the engine driving power output control in the deceleration state of the jet-propulsion personal watercraft 70 will be described. FIG. 15 is a flowchart showing the engine driving power output control in the watercraft 70 of FIG. 13. As shown in FIG. 15, steps S10 and S11 are similar to steps S1 and S2 in the first embodiment and will not be further described. If it is determined that the condition in step S11 is met, the ECU 77 determines whether or not the lateral relative speed of the water with respect to the body 2 which is detected by the speed sensor 71 is not lower than a predetermined value (step S12).

If it is determined that the lateral relative speed of the water which is detected by the speed sensor 71 is lower than the predetermined value (NO in step S12), the ECU 77 determines that the body 2 is not turning, and returns the process to step S1. On the other hand, if it is determined that the lateral relative speed of the water which is detected by the speed sensor 71 is not lower than the predetermined value (YES in step S12), the ECU 77 advances the process to step S13 which is similar to step S4 in the first embodiment and therefore will not be further described. If it is determined that the condition in step S13 is not met (NO in step 13), then the ignition timing control and the valve opening degree control are executed simultaneously, and thus, the engine driving power output control which is the sub-routine for suppressing decrease in the engine driving power output is executed (step S14). While the sub-routine in step S14 is run, the lateral relative speed of the water with respect to the body 2, which is detected by the speed sensor 71, is not lower than a predetermined value (step S15). If it is determined that the lateral relative speed is not lower than the predetermined value (YES in step S15), the ECU 77 returns the process to step S13, which is repeated.

Figure 16:
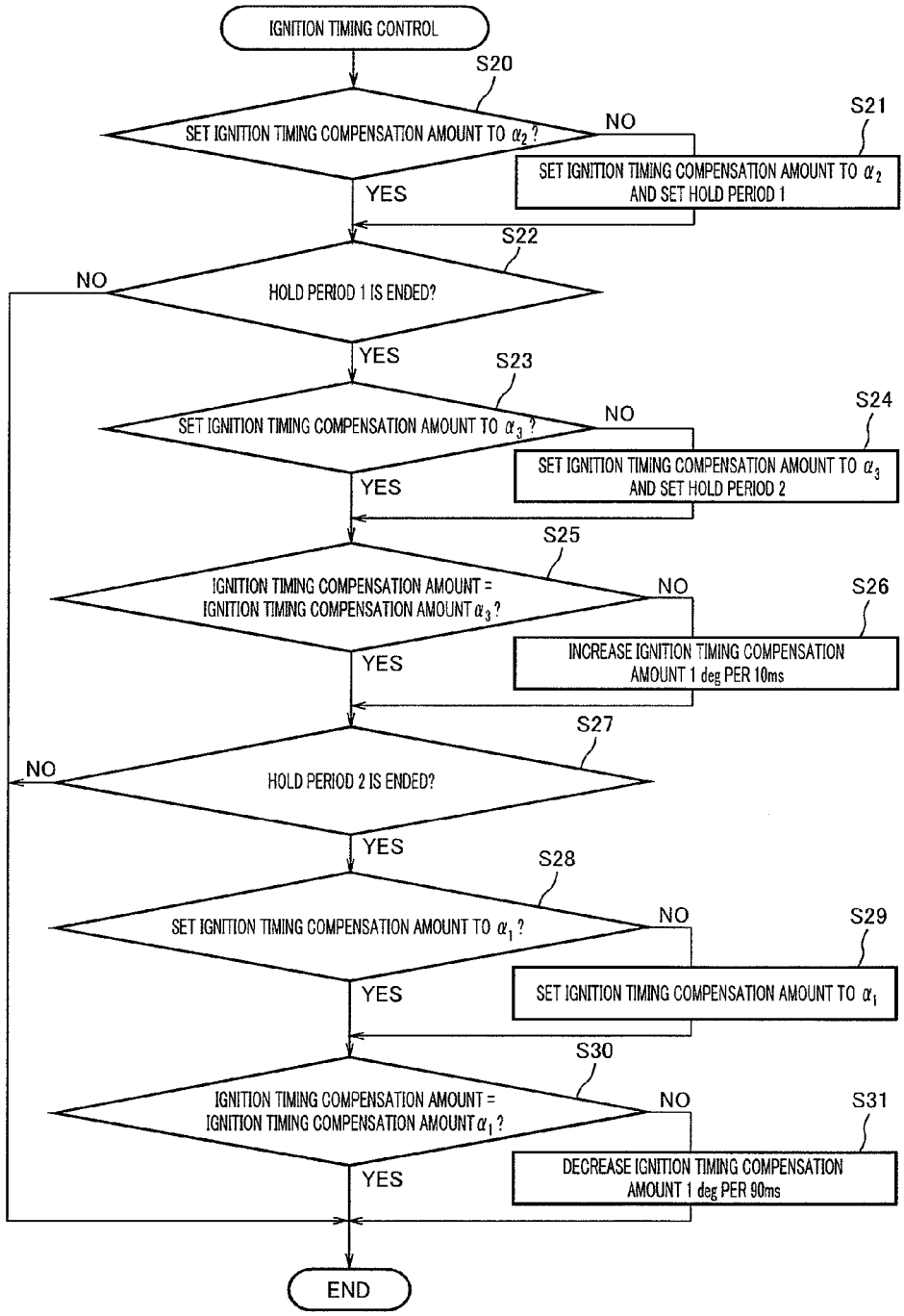
FIG. 16 is a flowchart showing ignition timing control of FIG. 15.
Figure 18:
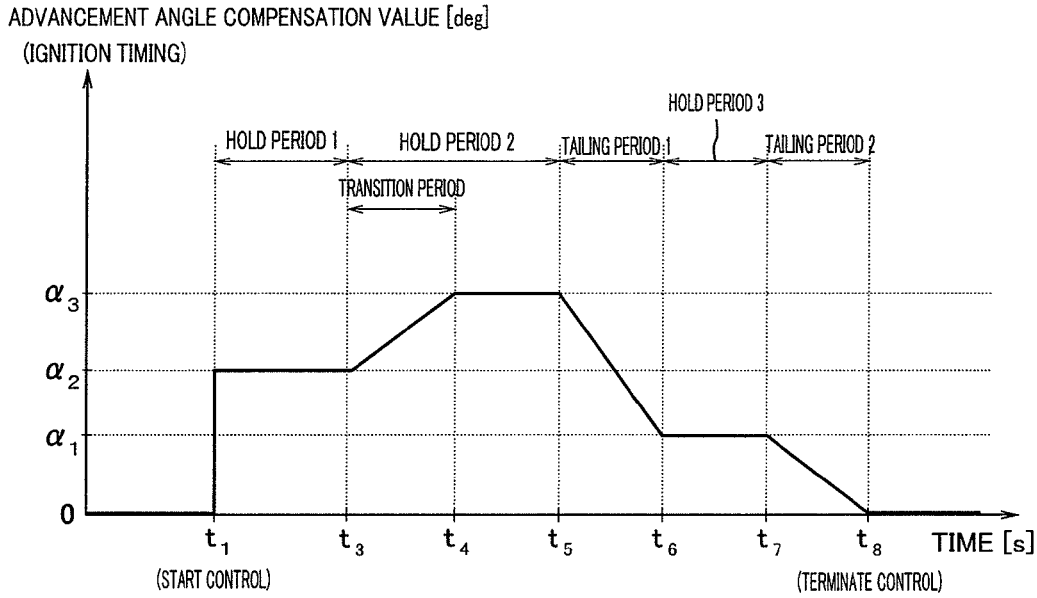
FIG. 18 is a graph showing ignition timing which is associated with the ignition timing control of FIG. 16.

Hereinafter, the ignition timing control and the valve opening degree control in step S14 will be described in detail separately. FIG. 16 is a flowchart showing the ignition timing control of FIG. 15. FIG. 18 is a graph showing ignition timing which is associated with the ignition timing control of FIG. 16. As shown in FIGS. 16 and 18, initially, the ECU 77 determines whether or not the ignition timing compensation amount is set to $\alpha 2$ (step S20). If it is determined that the ignition timing compensation amount is not set to $\alpha 2$ (NO in step S20), the ECU 77 sets the ignition timing compensation amount to $\alpha 2$ and sets a hold period 1 to a predetermined time period (t3−t1) (step S21). On the other hand, if it is determined that the ignition timing compensation amount is set to $\alpha 2$ (YES in step S20), the ECU 77 further determines whether or not the hold period 1 is ended (step S22). If it is determined that the hold period 1 is not ended (NO in step S22), the ECU 77 exits from the sub-routine to step S15 in the main flow chart of FIG. 15. Thereby, the state where the ignition timing compensation amount is set to $\alpha 2$ continues until the hold period 1 is ended.

If it is determined that the hold period 1 is ended (YES in step S22), the ECU 77 further determines whether or not the ignition timing compensation amount is set to $\alpha 3$ (step S23). If it is determined that the ignition timing compensation amount is not set to $\alpha 3$ (NO in step S23), the ECU 77 sets the ignition timing compensation amount to $\alpha 3$, gradually increases the ignition timing compensation amount from $\alpha 2$ to $\alpha 3$ in a transition time period (t4−t3), and sets a hold period 2 to a specified time period (t5−t3) (step S24). On the other hand, if it is determined that the ignition timing compensation amount is set to α3 (YES in step S23), the ECU 77 further determines whether or not an actual ignition timing compensation amount has reached α3 (step S25). If it is determined that the actual ignition timing compensation amount does not reach α3 (NO in step S25), the ECU 77 increases the ignition timing compensation amount to 1 degree per 10 msec (step S26). On the other hand, if it is determined that the actual ignition timing compensation amount has reached α3 (YES in step S25), the ECU 77 further determines whether or not the hold period 2 is ended (step S27). If it is determined that the hold period 2 is not ended (NO in step S27), the ECU 77 exits from the sub-routine to step S15 in the main flowchart of FIG. 15. Thereby, the state where the ignition timing compensation amount is set to α3 continues until the hold period 1 is ended.

If it is determined that the hold period 2 is ended (YES in step S27), the ECU 77 further determines whether or not the ignition timing compensation amount is set to α1 (step S28). If it is determined that the ignition timing compensation amount is not set to α1 (NO in step S28), the ECU 77 sets the ignition timing compensation amount to α1, and gradually decreases the ignition timing compensation amount from α3 to α1 (step S29). On the other hand, if it is determined that the ignition timing compensation amount is set to α1 (YES in step S28), the ECU 77 further determines whether or not an actual ignition timing compensation amount has reached α1 (step S30). If it is determined that the actual ignition timing compensation amount does not reach α1 (NO in step S30), the ECU 77 increases the actual ignition timing compensation amount 1 degree per 90 msec in a tailing period 1 (t6–t5) until the actual ignition timing compensation amount reaches α1 (step S31). If it is determined that the actual ignition timing compensation amount has reached α1 (YES in step S30), the ECU 77 exits from the sub-routine to the step S15 in the main flowchart of FIG. 15.

Figure 17:
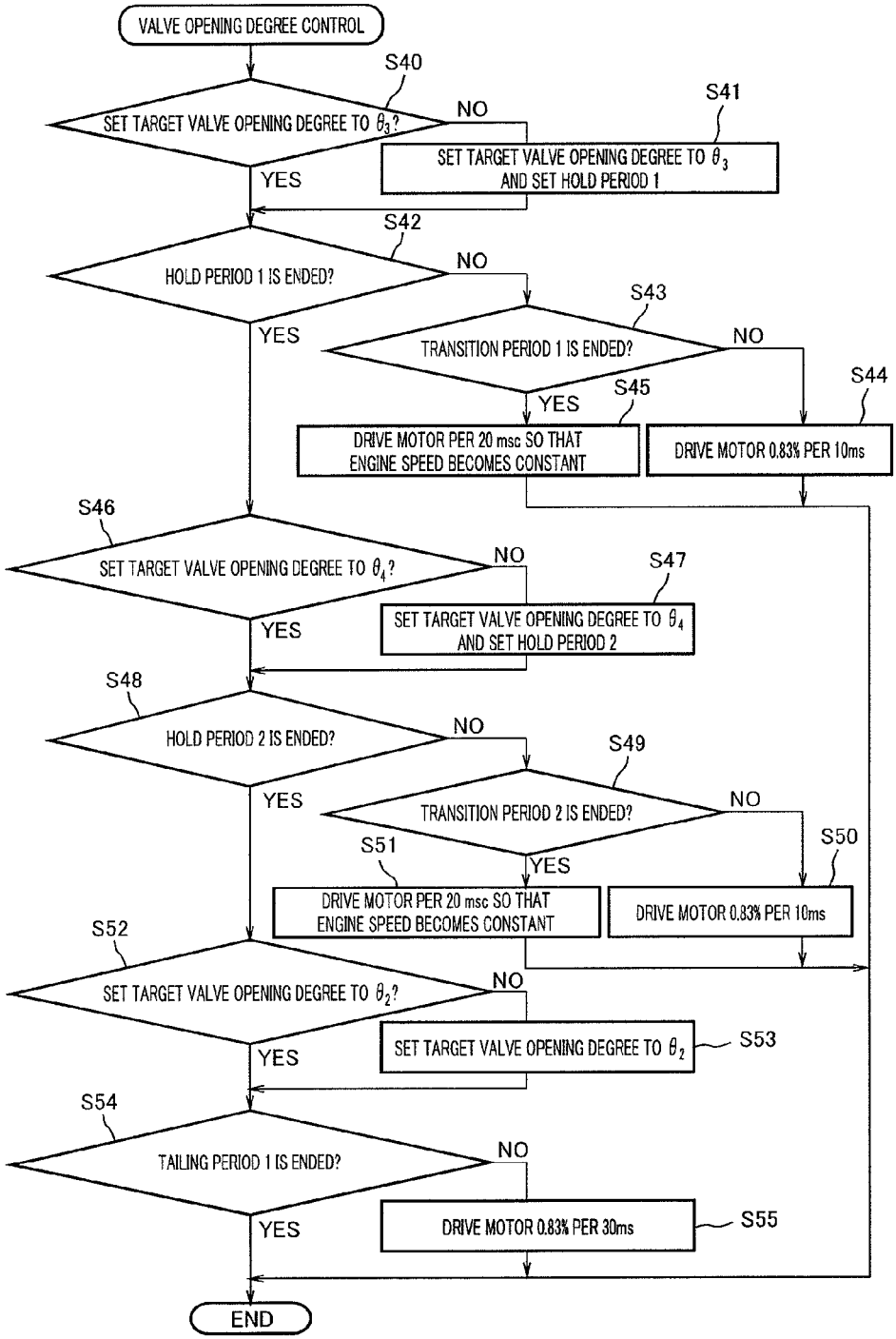
FIG. 17 is a flowchart showing valve opening degree control of FIG. 15.
Figure 19:
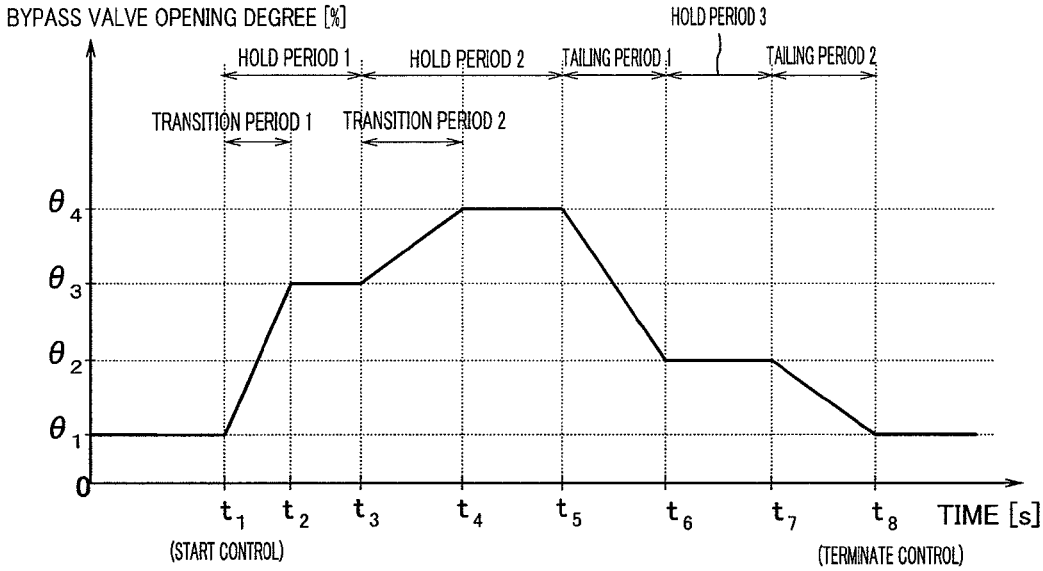
FIG. 19 is a graph showing a bypass valve opening degree which is associated with the valve opening degree control of FIG. 17.

FIG. 17 is a flowchart showing the valve opening degree control of FIG. 15. FIG. 19 is a graph showing a bypass valve opening degree which is associated with the valve opening degree control of FIG. 17. As shown in FIGS. 17 and 19, initially, the ECU 77 determines whether or not a target bypass valve opening degree is set to θ3 (step S40). If it is determined that the target bypass valve opening degree is not set to θ3 (NO in step S40), the ECU 77 sets the target bypass valve opening degree to θ3, gradually increases the bypass valve opening degree from θ1 to θ3 in a transition period 1 (t2–t1), and sets the hold period 1 to a specified time period (t3–t1) (step S41). If it is determined that the target bypass valve opening degree is set to θ3 (YES in step S40), the ECU 77 further determines whether or not the hold period 1 is ended (step S42). If it is determined that the hold period 1 is not ended (NO in step S42), the ECU 77 further determines whether or not the transition period 1 is ended (step S43).

If it is determined that the transition period 1 is not ended (NO in step S43), the ECU 77 causes the bypass valve motor 54 to increase the bypass valve opening degree by 0.83% per 10 msec (step S44). Then, the ECU 77 exits from the sub-routine to step S15 in the main flowchart of FIG. 5. On the other hand, if it is determined that the transition period 1 is ended (YES in step S43), the ECU 77 feed-back controls the bypass valve motor 54 to adjust the bypass valve opening per 20 msec, so that the engine speed becomes constant (step S45).

In addition, if it is determined that the hold period 1 is ended (YES in step S42), the ECU 77 further determines whether or not the target bypass valve opening degree is set to θ4 (step 46). If it is determined that the target bypass valve opening degree is not set to θ4 (NO in step 46), the ECU 77 sets the target bypass valve opening degree to θ4, gradually increases the bypass valve opening degree from θ3 to θ4 in a transition period 2 (t4–t3), and sets the hold period 2 to a specified time period (t5–t3) (step S47). On the other hand, if it is determined that the target bypass valve opening degree is set to θ4 (YES in step 46), the ECU 77 further determines whether or not the hold period 2 is ended (step S48). If it is determined that the hold period 2 is not ended (NO in step S48), the ECU 77 further determines whether or not the transition period 2 is ended (step S49).

If it is determined that the transition period 2 is not ended (NO in step S49), the ECU 77 drives the bypass valve motor 54 to increase the bypass valve opening degree by 0.83% per 10 msec (step S50), and exits from the sub-routine to step S15 in the main flowchart of FIG. 15. If it is determined that the transition period 2 is ended (YES in step S49), the ECU 77 feedback-controls the bypass valve motor 54 to adjust the bypass valve opening degree per 20 msec so that the engine speed becomes constant (step S51).

If it is determined that the hold period 2 is ended (YES in step S48), the ECU 77 further determines whether or not the target bypass valve opening degree is set to θ2 (step S52). If it is determined that the bypass valve opening is not set to θ2 (NO in step S52), the ECU 77 sets the target bypass valve opening degree to θ2, and gradually decreases the bypass valve opening degree from θ4 to θ2 in a tailing period 1 (t6–t5) (step S53). On the other hand, if it is determined that the bypass valve opening is set to θ2 (YES in step S52), the ECU 77 determines whether or not the tailing period 1 is ended (step S54). If it is determined the tailing period 1 is not ended (NO in step S54), the ECU 77 drives the bypass valve motor 54 to increase the bypass valve opening degree by 0.83% per 30 msec (step S55), and exits from the sub-routine to step S15 in the main flowchart of FIG. 15. On the other hand, if it is determined that the tailing period 1 is ended (YES in step S54), the ECU 77 immediately exits from the sub-routine to step S15 in the main flowchart of FIG. 15.

Turning to the flowchart of FIG. 15 again, in step S15, if it is determined that the lateral relative speed of the water with respect to the body 2, which is detected by the speed sensor 71, is lower than the predetermined value (NO in step S15), then the ECU 77 determines that the body 2 is not turning, and sets the ignition timing compensation amount to zero to terminate the ignition timing control, and terminates the valve opening degree control, thus terminating the sub-routine in step S14 (step S16). Thereby, the engine driving power output control mode transitions to the normal mode.

In accordance with the above described configuration, it can be determined whether or not the body 2 is turning, based on the lateral relative speed of the water with respect to the body 2 which is detected by the speed sensor 71, because the body 2 is moved in the lateral direction relative to the water while turning. If the turning determiner 78 determines that the body 2 is turning in the deceleration state, the decrease in the engine driving power output is retarded so that the propulsion force generated for the body 2 which is turning is larger than the propulsion force generated for the body 2 which is not turning. This makes it possible to maintain a suitable propulsion force in the case where the body 2 is turning in the deceleration state or to quickly decrease the engine driving power output in the case where the body 2 is not turning in the deceleration state. Since the speed sensor 71 is attached on the rear part of the body 2, which is moved with a larger amount in the lateral direction while turning, it is able to effectively detect the lateral relative speed of the body 2 with respect to the water. The other configuration is identical to that of the first embodiment and will not be further described.

Embodiment 3

Figure 20:
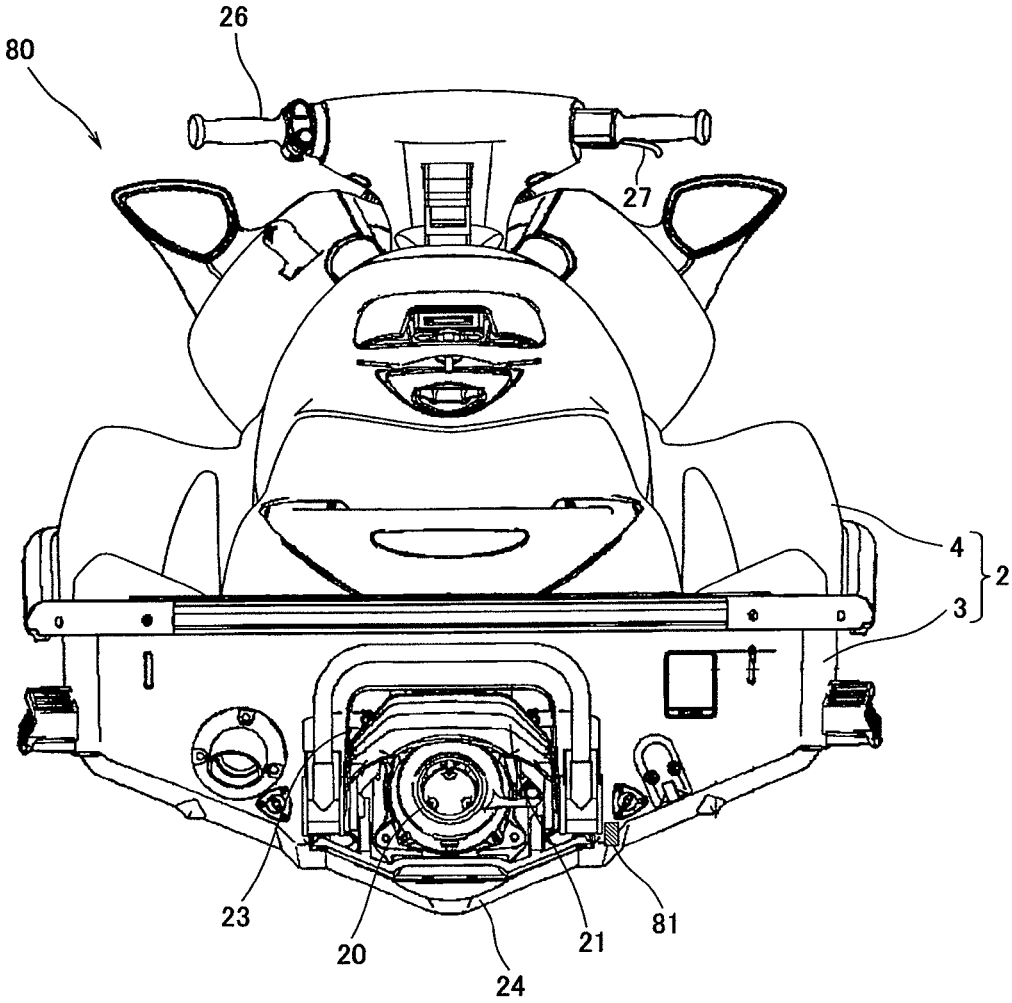
FIG. 20 is a partially cutaway rear view of a jet-propulsion personal watercraft according to a third embodiment of the present invention.

FIG. 20 is a partially cutaway rear view of a jet-propulsion personal watercraft 80 according to a third embodiment of the present invention. In the third embodiment, the same reference numerals as those in the second embodiment denote the same or corresponding parts which will not be further described. As shown in FIG. 20, an optical sensor 81 is attached on the rear part of the hull 3 and is positioned in the vicinity of a right side of the pump space 25 located at the center region, in the lateral direction. The optical sensor 18 is attached to be located under the surface of the water on which the body 2 is floating. An output cable (not shown) of the optical sensor 81 is coupled to the ECU 77. The optical sensor 81 serves as a speed sensor which detects a lateral relative speed of minute substances such as trash, bugs, or sand existing in the water on which the body 2 is floating, thereby detecting a lateral relative speed of the water with respect to the body 2.

In the above described configuration, it can be determined whether or not the body 2 is turning as in the second embodiment, based on the lateral relative speed of the water with respect to the body 2 which is detected by the optical sensor 81. The other configurations and functions are identical to that of the second embodiment, and will not be further described.

Embodiment 4

Figure 21:
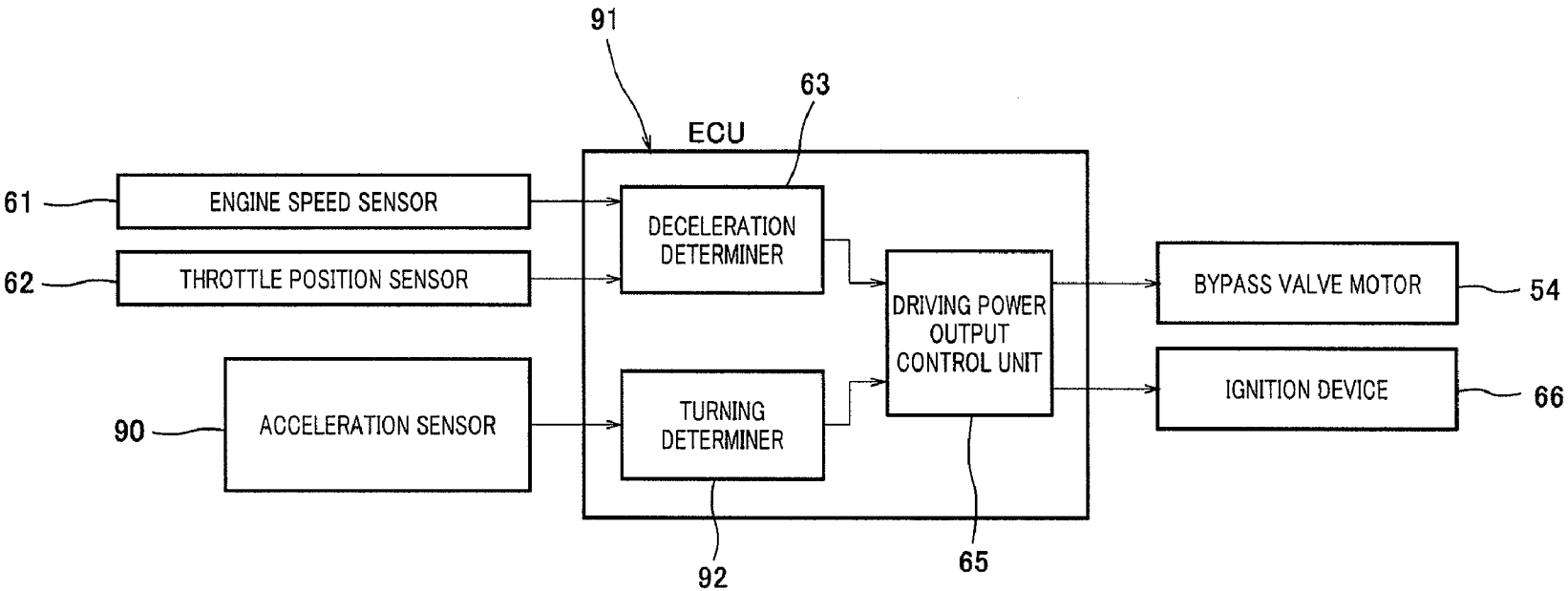
FIG. 21 is a block diagram showing an ECU and other components built into a jet-propulsion personal watercraft according to a fourth embodiment of the present invention.

FIG. 21 is a block diagram showing an ECU 91 and other components built into a jet-propulsion personal watercraft according to a fourth embodiment of the present Invention. As shown in FIG. 21, an acceleration sensor 90 is communicatively coupled to the ECU 91. The acceleration sensor 90 is attached on the rear part of the body 2 (FIG. 1) behind the seat 6 (FIG. 1) and is oriented to be able to detect a lateral (horizontal direction perpendicular to the moving direction) acceleration of the body 2. The ECU 91 includes a turning determiner 92 configured to determine whether or not the body 2 of the watercraft 1 is turning. To be specific, the turning determiner 92 determines that the body 2 is turning when the lateral acceleration detected by the acceleration sensor 90 is not smaller than a predetermined value. The engine speed sensor 61, the throttle position sensor 62, the deceleration determiner 63, the driving power output control unit 65, the bypass valve motor 54, and the ignition device 66 are identical to those of the first embodiment.

In the above described configuration, it can be determined whether or not the body 2 is turning, based on the lateral acceleration of the body 2 (FIG. 1) which is detected by the acceleration sensor 90. If the turning determiner 92 determines that the body 2 is turning, the decrease in the engine driving power output is retarded so that the propulsion force generated for the body 2, which is turning is larger than the propulsion force generated for the body 2 which is not turning. Since the acceleration sensor 90 is attached on the rear part of the body 2, which is moved with a larger amount in the lateral direction while turning, it is able to effectively detect the lateral acceleration of the body 2. The other configuration is identical to that of the first embodiment, and therefore will not be further described.

Embodiment 5

Figure 22:
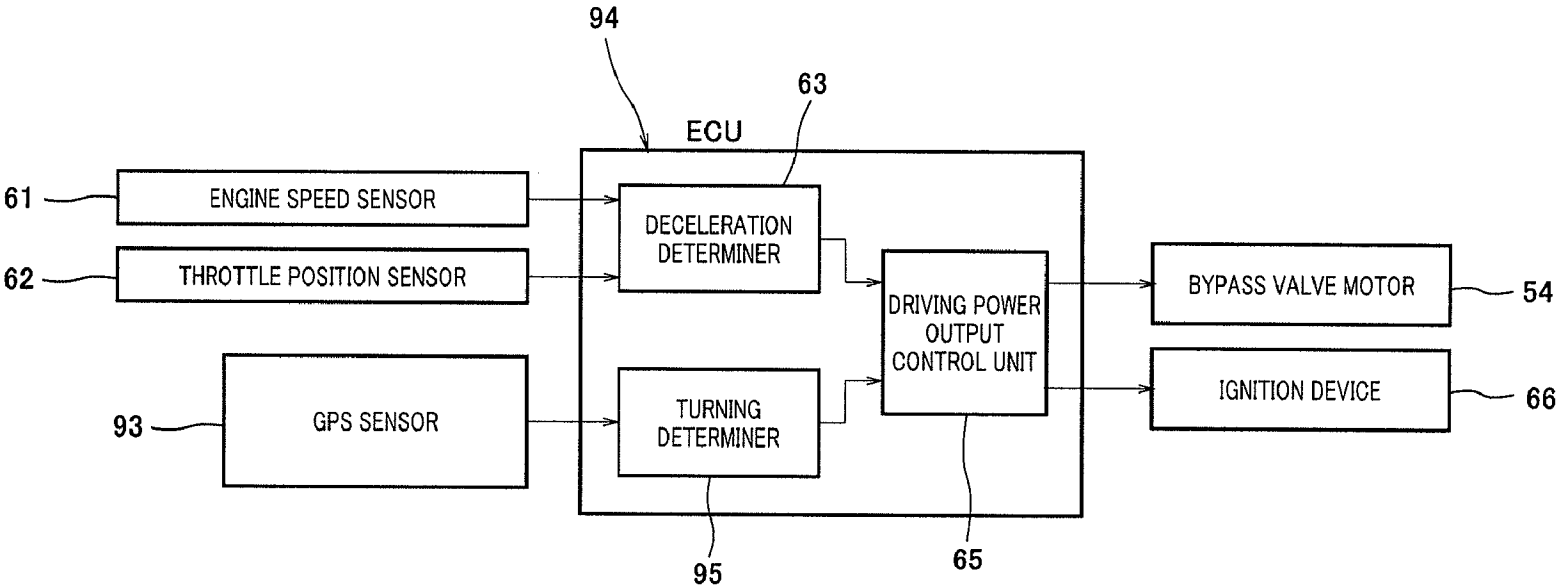
FIG. 22 is a block diagram showing an ECU and other components built into a jet-propulsion personal watercraft according to a fifth embodiment of the present invention.

FIG. 22 is a block diagram showing an ECU 94 and other components built into a jet-propulsion personal watercraft according to a fifth embodiment of the present Invention. As shown in FIG. 22, a GPS (global positioning system) sensor 93 is coupled to the ECU 94. The GPS sensor 93 is attached in the vicinity of a center of gravity of the body 2 (FIG. 1). The GPS sensor 93 is coupled to a GPS and is configured to be able to obtain location information of the body 2. The ECU 94 includes a turning determiner 95 configured to determine whether or not the body 2 is turning. To be specific, the turning determiner 95 determines that the body 2 is turning when a movement track of the body 2 is not smaller than a predetermined curvature based on the location information obtained substantially continuously by the GPS sensor 93. The engine speed sensor 61, the throttle position sensor 62, the deceleration determiner 63, the driving power output control unit 65, the bypass valve motor 54, and the ignition device 66 are identical to those of the first embodiment.

In accordance with the above described configuration, by analyzing the movement track of the body 2 obtained from the location information of the body 2 which is detected by the GPS sensor 93, it can be determined whether or not the body 2 is turning. If the turning determiner 95 determines that the body 2 is turning in the deceleration state, the decrease in the engine driving power output is retarded so that the propulsion force generated for the watercraft 1 which is turning is larger than the propulsion force generated for the watercraft 1 which is not turning. The other configuration is identical to that of the first embodiment, and therefore will not be further described.

Embodiment 6

Figure 23:
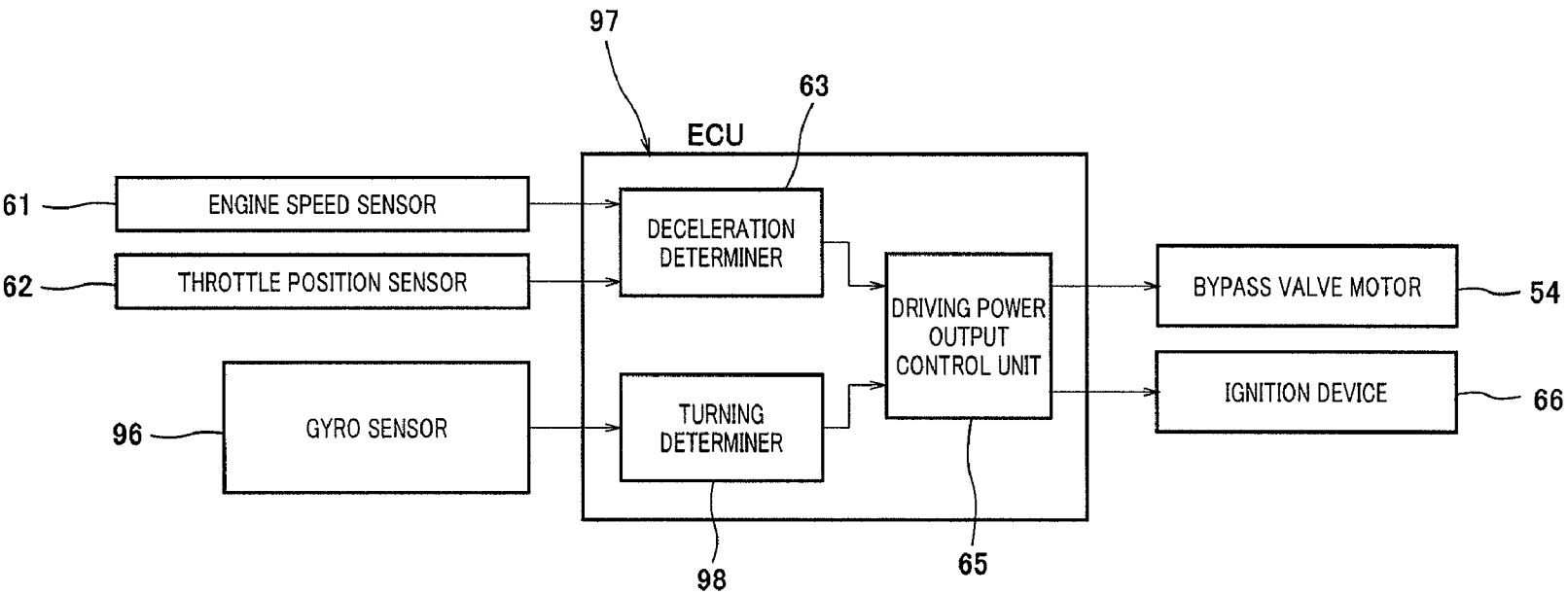
FIG. 23 is a block diagram showing an ECU and other components built into a jet-propulsion personal watercraft according to a sixth embodiment of the present invention.

FIG. 23 is a block diagram showing an ECU 97 and other components built into a jet-propulsion personal watercraft according to a sixth embodiment of the present invention. In the sixth embodiment, the same reference numerals as those in the first embodiment denote the same or corresponding parts which will not be further described. As shown in FIG. 23, a gyro sensor 96 is communicatively coupled to the ECU 97, to detect an angular speed of the body 2 (FIG. 1). The gyro sensor 96 is attached in the vicinity of a center of gravity of the body 2, and is disposed to be able to detect an angular speed of a rotational movement of the body 2, whose rotational axis conforms to the moving direction of the body 2. To be more specific, the gyro sensor 96 is able to detect a posture of the body 2 which is tilted in the lateral direction. The ECU 97 includes a turning determiner 98 configured to determine whether or not the body 2 is turning. The turning determiner 98 is configured to determine that the body 2 is turning when the angular speed detected by the gyro sensor 96 is not smaller than a predetermined value. The engine speed sensor 61, the throttle position sensor 62, the deceleration determiner 63, the driving power output control unit 65, the bypass valve motor 54, and the ignition device 66 are identical to those of the first embodiment.

In accordance with the above described configuration, by analyzing the posture of the body 2 which is detected by the gyro sensor 96, it can be determined whether or not the body 2 (FIG. 1) is turning. If the turning determiner 98 determines that the body 2 is turning in the deceleration state, the decrease in the engine driving power output is retarded so that the propulsion force generated for the body 2 which is turning is larger than the propulsion force generated for the body 2 which is not turning.

Whereas in the above described embodiments, the pressure sensors 28 and 20, the speed sensor 71, the optical sensor 81, the acceleration sensor 90, the GPS sensor 93 or the gyro sensor 96 is used to determine whether or not the body 2 of the watercraft 1 is turning, a plurality of sensors may be selected from them and may be combined. In this case, if signals output from the selected sensors meet the above described conditions, it may be determined that the body 2 is turning. This advantageously improves determination precision.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A jet-propulsion personal watercraft comprising:

a body including a hull and a deck;

an engine mounted to the body;

a driving power output changing system configured to be able to change a driving power output of the engine;

a controller configured to control an operation of the driving power output changing system;

a pressure sensor configured to be able to detect a pressure which is applied to the body from water on which the body is floating, the pressure having a component in a lateral direction of the body;

wherein the controller includes a turning determiner configured to determine whether or not the body is turning in the lateral direction by steering the body, based on a signal received from the pressure sensor; and a driving power output control unit configured to control the driving power output changing system based on information received from the turning determiner;

wherein the controller includes a deceleration determiner configured to determine whether or not the watercraft is decelerating; and wherein the driving power output control unit is configured to control the driving power output changing system to maintain a propulsion force for turning the body, when the deceleration determiner determines that the watercraft is decelerating and the turning determiner determines that the body is turning.

2. The jet-propulsion personal watercraft according to claim 1, wherein the driving power output control unit is configured to increase a driving power output of the engine in a case where the turning determiner determines that the body is turning, to maintain the propulsion force for turning the body such that the driving power output is larger than a driving power output of the engine in a case where the turning determiner determines that the body is not turning.

3. A jet-propulsion personal watercraft comprising:

a body including a hull and a deck;

an engine mounted to the body;

a driving power output changing system configured to be able to change a driving power output of the engine;

a controller configured to control an operation of the driving power output changing system; and a pressure sensor configured to be able to detect a pressure which is applied to the body from water on which the body is floating, the pressure having a component in a lateral direction of the body;

wherein the controller includes a turning determiner configured to determine whether or not the body is turning in the lateral direction by steering the body, based on a signal received from the pressure sensor; and a driving power output control unit configured to control the driving power output changing system based on information received from the turning determiner;

wherein the pressure sensor includes a first pressure sensor which is configured to be able to detect a pressure having a rightward component, and a second pressure sensor which is configured to be able to detect a pressure having a leftward component; and wherein the turning determiner is configured to determine that the body is turning, when a difference between the pressure detected by the first pressure sensor and the pressure detected by the second pressure sensor is not smaller than a predetermined value.

4. The jet-propulsion personal watercraft according to claim 3, where the first pressure sensor is disposed to detect a rightward pressure and the second pressure sensor is disposed to detect a leftward pressure.

5. The jet-propulsion personal watercraft according to claim 3, wherein the first pressure sensor is disposed to detect a pressure in one direction which is substantially perpendicular to a turning direction of the body and the second pressure sensor is configured to detect a pressure in an opposite direction which is substantially opposite to the one direction.

6. The jet-propulsion personal watercraft according to claim 3, wherein the first pressure sensor is a right pressure sensor attached on a right side of a rear part of the body, and the second pressure sensor is a left pressure sensor attached on a left side of the rear part of the body.

7. The jet-propulsion personal watercraft according to claim 1, wherein the pressure sensor is a single pressure sensor attached on the body; and wherein the turning determiner determines that the body is turning when the pressure detected by the pressure sensor is outside a reference range.

8. The jet-propulsion personal watercraft according to claim 1, further comprising:

an engine speed sensor configured to be able to detect an engine speed of the engine;

wherein the driving power output changing system includes an air-intake passage through which air taken in from outside is guided to the engine, an intake valve configured to substantially open and close the air-intake passage, and an intake valve driving device configured to drive the intake valve;

wherein the intake valve is attached with an opening degree sensor configured to be able to detect an opening degree of the intake valve; and wherein the deceleration determiner determines that the watercraft is decelerating when the engine speed detected by the engine speed sensor is not lower than a predetermined value and the opening degree detected by the opening degree sensor is not larger than a predetermined value.

9. The jet-propulsion personal watercraft according to claim 1, wherein the driving power output changing system includes an air-intake passage through which air taken in from outside is guided to the engine, an intake valve configured to substantially open and close the air-intake passage, and an intake valve driving device configured to drive the intake valve; and wherein the driving power output control unit is configured to execute valve opening degree control for causing the intake valve driving device to control an opening degree of the intake valve to maintain a propulsion force for turning the body, when the deceleration determiner determines that the watercraft is decelerating, and the turning determiner determines that the watercraft is turning.

10. The jet-propulsion personal watercraft according to claim 9, wherein the air-intake valve includes a throttle valve configured to substantially open and close the air-intake passage according to an amount of a driver's operation, and a bypass valve configured to substantially open and close a bypass passage connected to the air-intake passage so as to bypass the throttle valve;

wherein the intake valve driving device is a bypass valve driving device configured to drive the bypass valve; and wherein the driving power output control unit is configured to execute valve opening degree control for causing the bypass valve driving device to increase or maintain an opening degree of the bypass valve, when the deceleration determiner determines that the watercraft is decelerating and the turning determiner determines that the watercraft is turning.

11. The jet-propulsion personal watercraft according to claim 1, wherein the driving power output changing system includes an ignition device configured to ignite an air-fuel mixture in the engine; and wherein the driving power output control unit is configured to execute ignition timing control for increasing an advancement angle value of ignition timing of the ignition device, when the deceleration determiner determines that the watercraft is decelerating and the turning determiner determines that the watercraft is turning.

* * * * *